US008511252B2

(12) United States Patent
Byrne et al.

(10) Patent No.: US 8,511,252 B2
(45) Date of Patent: Aug. 20, 2013

(54) APPARATUS FOR GLUING THE TAIL OF A CONVOLUTELY WOUND WEB MATERIAL THERETO

(75) Inventors: Thomas Timothy Byrne, West Chester, OH (US); Thomas Edward Franklin, Florence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 119 days.

(21) Appl. No.: 13/020,060

(22) Filed: Feb. 3, 2011

(65) Prior Publication Data

US 2011/0155326 A1 Jun. 30, 2011

Related U.S. Application Data

(63) Continuation of application No. 11/473,554, filed on Jun. 23, 2006, now Pat. No. 7,905,194.

(51) Int. Cl.
*B05C 5/02* (2006.01)

(52) U.S. Cl.
USPC ..... 118/410; 118/411; 118/412; 118/423; 118/426; 156/578

(58) Field of Classification Search
USPC ..... 118/410–412, 423, 426; 156/191, 156/446, 578, 184; 427/207.1; 242/532, 242/532.3
See application file for complete search history.

(56) References Cited

U.S. PATENT DOCUMENTS

| | | | | |
|---|---|---|---|---|
| 1,391,281 | A | | 9/1921 | Snyder |
| 2,192,453 | A | | 3/1940 | Rentsch |
| 2,357,476 | A | | 9/1944 | Kaulen |
| 2,755,768 | A | | 7/1956 | Oslon |
| 3,044,532 | A | | 7/1962 | Ghisoni |
| 3,113,884 | A | | 12/1963 | Kohler |
| 3,134,706 | A | | 5/1964 | Alexander |
| 3,415,221 | A | | 12/1968 | Stenger |
| 3,532,572 | A | | 10/1970 | Herman |
| 3,532,573 | A | | 10/1970 | Herman |
| 3,553,055 | A | | 1/1971 | Janik |
| 3,696,777 | A | | 10/1972 | Preen |
| 3,806,388 | A | | 4/1974 | Contini |
| 3,935,057 | A | | 1/1976 | Gray |
| 4,026,752 | A | | 5/1977 | Hartbauer et al. |
| 4,244,767 | A | | 1/1981 | Hoeboer |
| 4,299,642 | A | | 11/1981 | Berkholtz |
| 4,475,974 | A | | 10/1984 | Perini |
| 4,548,825 | A | * | 10/1985 | Voss et al. ..... 426/383 |

(Continued)

FOREIGN PATENT DOCUMENTS

| | | | |
|---|---|---|---|
| EP | 0481929 | * | 4/1992 |
| EP | 1 184 313 B1 | | 4/2005 |
| EP | 1 197 453 B1 | | 11/2005 |

*Primary Examiner* — Laura Edwards

(74) *Attorney, Agent, or Firm* — Peter D. Meyer

(57) ABSTRACT

An apparatus for applying a fluid to a convolutely wound roll of web substrate is disclosed. The apparatus provides for a fluid applicator having a manifold and a first surface. The fluid is fluidly displaceable from the manifold to the first surface through at least one opening disposed therein. The convolutely wound roll of web substrate is disposable upon the first surface. At least a portion of the fluid is fluidly displaced from the first surface to the convolutely wound roll of web substrate. Any of the fluid not fluidly displaced from the first surface to the convolutely wound roll of web substrate is not displaceable back into then manifold.

19 Claims, 17 Drawing Sheets

(56) References Cited

U.S. PATENT DOCUMENTS

| | | | | |
|---|---|---|---|---|
| 4,609,421 | A | | 9/1986 | Yui |
| 4,693,766 | A | | 9/1987 | Stauffer |
| 4,695,482 | A | | 9/1987 | Weiswurm |
| 4,708,629 | A | | 11/1987 | Kasamatsu |
| 4,791,879 | A | | 12/1988 | Eklund et al. |
| 4,931,130 | A | | 6/1990 | Biagiotti |
| 5,033,403 | A | | 7/1991 | Mladota |
| 5,040,738 | A | | 8/1991 | Biagiotti |
| 5,045,140 | A | | 9/1991 | Dickey |
| 5,137,225 | A | | 8/1992 | Biagiotti |
| 5,169,447 | A | | 12/1992 | Jonovic et al. |
| 5,199,991 | A | | 4/1993 | Chance |
| 5,242,525 | A | | 9/1993 | Biagiotti |
| 5,259,910 | A | | 11/1993 | Biagiotti |
| 5,474,646 | A | | 12/1995 | Matteucci |
| 5,573,615 | A | | 11/1996 | Vigneau et al. |
| 5,643,398 | A | | 7/1997 | Lumberg |
| 5,654,041 | A | * | 8/1997 | Appich et al. ..... 427/434.5 |
| RE35,729 | E | | 2/1998 | Biagiotti |
| 5,716,489 | A | | 2/1998 | Biagiotti |
| 5,759,326 | A | | 6/1998 | Vigneau |
| 5,800,652 | A | | 9/1998 | Vigneau |
| 6,050,519 | A | | 4/2000 | Biagiotti |
| 6,143,111 | A | | 11/2000 | Biagiotti |
| 6,145,777 | A | | 11/2000 | Zach et al. |
| RE37,039 | E | | 2/2001 | Biagiotti |
| 6,372,064 | B1 | | 4/2002 | Butterworth et al. |
| 6,544,335 | B2 | | 4/2003 | Gambini |
| 6,620,241 | B2 | | 9/2003 | Gambini |
| 6,682,623 | B1 | | 1/2004 | Biagiotti |
| 6,758,923 | B2 | | 7/2004 | Butterworth et al. |
| 2004/0086698 | A1 | | 5/2004 | Collins et al. |

* cited by examiner 6A
6A
18
22
40
22
40
40
40
38
38
38
38
20
18

7A
18
40
20
40
20
18

APPARATUS FOR GLUING THE TAIL OF A CONVOLUTELY WOUND WEB MATERIAL THERETO

CROSS-REFERENCE TO RELATED PATENT APPLICATION

This application is a continuation of patent application Ser. No. 11/473,554 filed Jun. 23, 2006, now U.S. Pat No. 7,905,194.

FIELD OF THE INVENTION

The present invention provides for an apparatus and process for gluing the tail or other end of a convolutely wound web material thereto in order to form a roll or log suitable for consumer use.

BACKGROUND OF THE INVENTION

In the manufacture of rolled web products, a winder winds a web of material to form a large parent roll. The parent roll is then subsequently unwound, subjected to a variety of conversions, such as embossing, and then rewound by a rewinder into a consumer diameter sized convolutedly wound log. The convolutely wound log is eventually cut into consumer width size rolls, such as bath tissue, paper towels, and similar finished products. Several of these finished products can be provided with a "handle" with which a consumer may grasp the end of the convolutely wound log in order to initiate use of the rolled web material.

As would be known to those of skill in the art, there are a number of well known manners in which the tail, or end, of a convolutely wound product may be secured or sealed thereto. Common gluing, moistening, and other systems known to those in the tail gluing art typically require some manipulation of the tail, or end, of the convolutedly wound roll for correct alignment in glue application, proper rewinding, and the like. In most commercially available embodiments, the tail of the convolutely wound product is laid flat and unwrinkled against the log with the tail being secured to the log at a position a short distance from the very end of the tail. This tail sealing arrangement leaves a small length of the end of the tail unsecured to enable the end user to grasp, unseal, and unwind the convolutely wound product.

Several of the known methods and systems for sealing the tail of a convolutely wound product to the log are designed to avoid undesirable results of improper tail manipulation and improper glue placement and delivery while maintaining a high rate of product output. However, these known methods and systems for such tail sealers are quite complex and employ expensive systems and subsystems to separate and orient the tail of each convolutely wound roll in a precise manner. Applying adhesive to the tail or log in a precise location can seal the tail on the log without wrinkling. However, such systems are costly and at times can be deemed as unreliable and producing final products that do not meet existing quality control standards. Such exemplary tail sealers are disclosed in U.S. Pat. Nos. 3,113,884; 4,026,752; 5,259,910; 5,474,646; 5,759,326; 3,696,777; 6,145,777; 6,372,064; RE 35,729; RE 37,039; U.S. 2004/0086698 A1; and U.S. 2004/0256513 A1.

Besides being expensive in terms of manufacture and maintenance, the aforementioned systems are not without additional problems. Several of the embodiments mentioned dispense excess glue through a slit or a plurality of adjacent slits so that the excess glue overflows from the slits. Such excess glue that is not picked up by the convolutely wound rolls is collected in an underlying tank from which it can be recovered and made to flow back into the system. Such systems thus allow dust, debris, and other foreign matter to be incorporated into the glue that is overflowing from the slit, thus polluting the glue flow stream and/or reducing the effectiveness of the glue upon subsequent rolls of convolutely wound material. Such systems typically incorporate filtration systems in an effort to remove such pollutants from the adhesive stream. Such filtration systems add increased cost to the systems as well as provide routine maintenance issues.

Other known systems incorporate the use of a wire and/or a blade that is dipped into a pool or bath of adhesive and is then subsequently brought into contacting engagement with a log of convolutely wound web material. Again, such a system is provided in an open condition, thereby allowing the aforementioned pollutants to enter the adhesive stream, thereby reducing the effectiveness of the adhesive both in terms of attachment to the convolutely wound material and to attachment of the tail to the convolutely wound web material after application of the adhesive thereto. In such systems, the wire is typically either maneuvered relative to such a bath of adhesive, or the adhesive is manipulated relative to the wire. Again, such systems require extra equipment and components to both manipulate the wire and the adhesive.

Thus, it would be advantageous to provide for a tail gluing system that facilitates the transfer of adhesive to a convolutely wound roll of web material that minimizes or even eliminates the prospect of pollution to the adhesive fluid stream. Likewise, it would be advantageous to provide for such a system wherein the adhesive applied to the convolutely wound web material can be placed in a pattern or provide for indicia to be disposed upon the convolutely wound web material fowling the final product. Additionally, it would be beneficial to provide for such a system that increases throughput, reduces the components required to operate an effective tail gluing system, and provides for a mechanism that reduces the maintenance required upon such a tail gluing system.

SUMMARY OF THE INVENTION

The instant application provides for an apparatus for applying a fluid to a convolutely wound roll of web substrate. The apparatus comprises a fluid applicator. The fluid applicator further comprises a manifold and a first surface. The fluid is fluidly displaceable from the manifold to the first surface through at least one opening disposed therein. The convolutely wound roll of web substrate is disposable upon the first surface. At least a portion of the fluid is fluidly displaced from the first surface to the convolutely wound roll of web substrate. Any of the fluid not fluidly displaced from the first surface to the convolutely wound roll of web substrate is not displaceable back into the manifold.

Another embodiment of the present invention provides for an apparatus for sealing the tail of a convolutely wound roll of web substrate to the convolutely wound roll of web substrate with an adhesive. The apparatus comprises an adhesive applicator. The adhesive applicator comprises a manifold and a first surface. The adhesive is fluidly displaceable through the applicator from the manifold to the first surface through at least one opening disposed therein. The convolutely wound roll is disposed on the adhesive applicator. At least a portion of the adhesive disposed upon the first surface is transferable to the convolutely wound roll of web substrate. Any of the adhesive not transferred to the convolutely wound roll of web substrate is not displaceable back into the manifold.

DETAILED DESCRIPTION OF THE INVENTION

Figure 1:
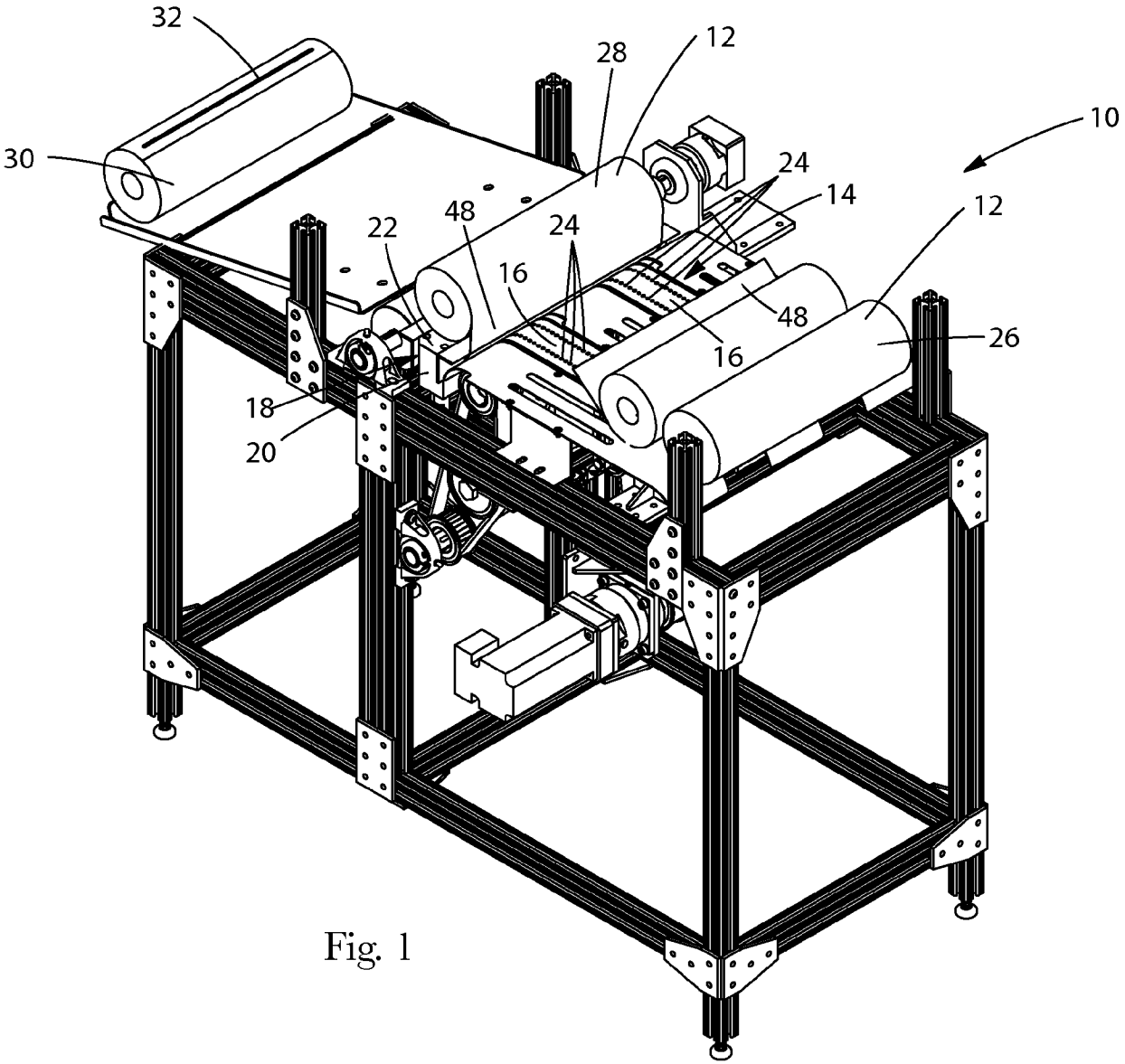
FIG. 1 is a perspective view of the lower portion of a tail sealing apparatus as seen from line 2-2 of FIG. 3A in accordance with the present invention.
Figure 2:
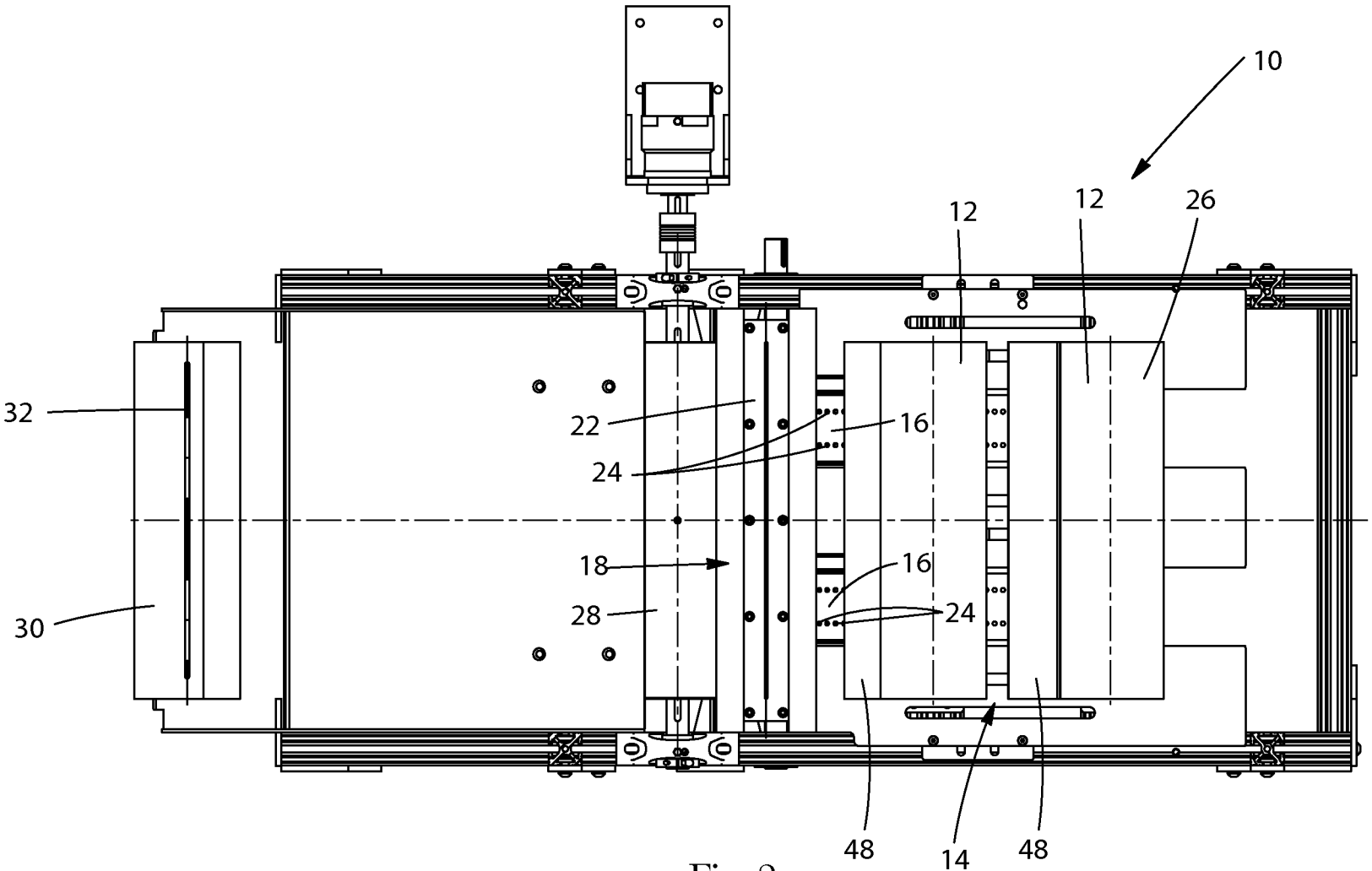
FIG. 2 is a plan view of the apparatus of FIG. 1.

With reference to FIG. 1, a tail sealing apparatus 10 according to the present invention comprises an in-feed mechanism 14 within and/or upon which a plurality of convolutely wound web substrates 12 can be disposed when they are discharged from an upstream-located rewind system (not shown). Alternatively, convolutely wound web substrates 12 can be manually disposed within and/or upon in-feed mechanism 14 as required without the need for upstream processing and/or converting, as required by the operator/operation. Downstream of the in-feed mechanism is at least one in-feed belt 16 upon which a convolutely wound web substrate 12 progresses towards adhesive applicator 18. The at least one in-feed belt is preferably provided as a pair of in-feed belts where one belt is disposed above and one belt is disposed below the convolutely wound web substrate 12 disposed within in-feed mechanism 14. The at least one in-feed belt 16 generally progresses convolutely wound web substrate 12 toward adhesive applicator 18.

Adhesive applicator 18 generally comprises a manifold 20 and an applicator surface 22 through which an adhesive and or other fluid can be disposed upon the convolutely wound web substrate 12 so that the functions performed upon convolutely wound web substrate 12 ultimately consummate in the tail portion 48 of the convolutely wound web substrate 12 being secured to the immediately subjacent convolution. Convolutely wound web substrate 12 having a tail portion 48 sealed thereto can then be dispensed from tail sealer apparatus 10 for further downstream processing. In an alternative embodiment, any combination of tail sealing apparatus 10, in-feed mechanism 14, and/or adhesive applicator 18 can be disposed in any desired orientation with respect to the horizon in order to accommodate the needs of the system and/or operator producing convolutely wound web substrate 12. This could include vertical orientations of one or all components, horizontal orientations for one or all components, and combinations thereof.

The convolutely wound web substrate 12 may be wound from a web of any suitable material (for example, cloth of either natural or synthetic fibers, plastic materials, metallic foils, and paper in the form of single layer or multi-layer laminates). An exemplary, but not limiting, embodiment of convolutely wound web substrate 12 provides for a convolutely wound web substrate 12 of bath tissue that will be eventually cut into individual roll widths and then enclosed in appropriate wrappers after the tail portion 48 of the convolutely wound web material 12 has been secured to the convolution underlying the same. The convolutely wound web substrate 12 may be of any suitable length and/or diameter, and the apparatus is designed to accommodate any predetermined maximum length and/or diameter of convolutely wound web material 12. As may concern a convolutely wound web substrate 12 comprising bath tissue, the length thereof depends upon the characteristics of the rewinding machinery and the desired end product configuration.

Figure 3A:
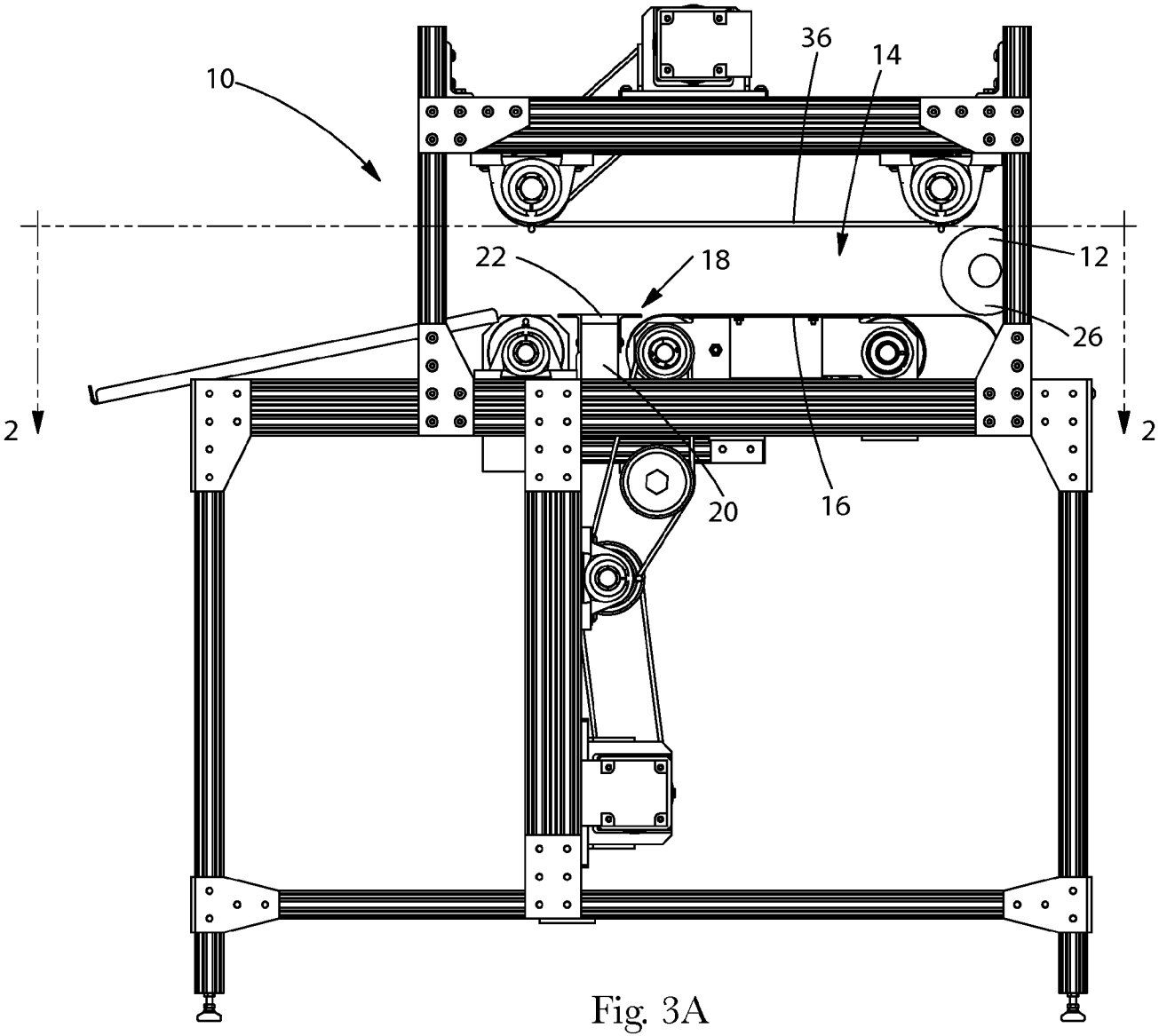
FIG. 3A is an elevational view of the apparatus of FIG. 1 showing the introduction of a convolutely wound web material.

Referring to FIGS. 1, 2, and 3A-3G, a convolutely wound web substrate 12 is shown during various points of the process of use of an exemplary, but non-limiting, embodiment of tail sealer apparatus 10. Referring to FIG. 3A, an early stage convolutely wound web substrate 26 is introduced to tail sealer apparatus 10 proximate to in-feed mechanism 14 by any process known, or desired, to those of skill in the art in the production of convolutely wound web substrate 12.

Figure 3B:
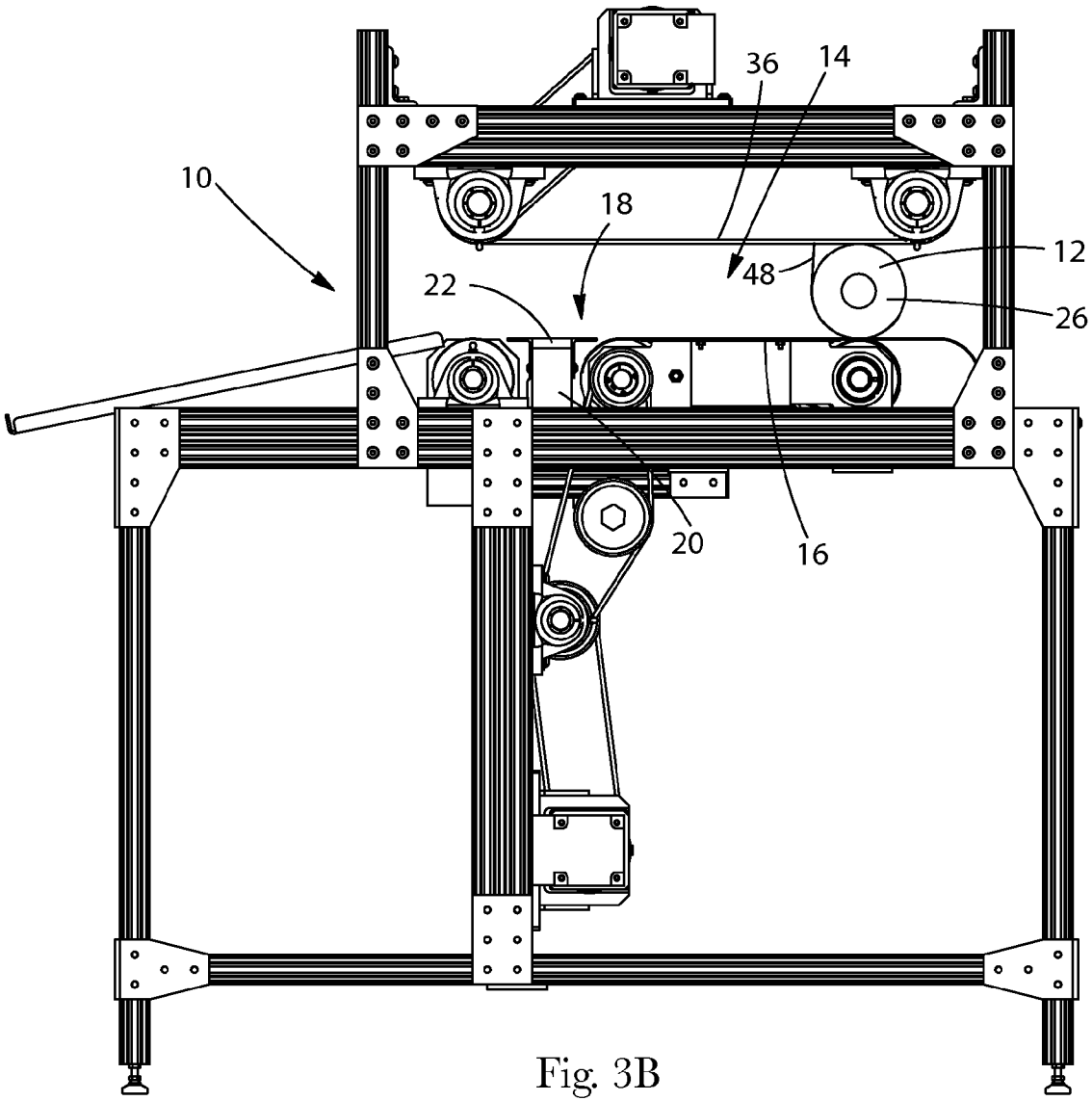
FIG. 3B is an elevational view of the apparatus of FIG. 1 showing a convolutely wound web material progressing therethrough.

As shown in FIG. 3B, a convolutely wound web substrate 12 progresses into and through in-feed mechanism 14 and is disposed between lower in-feed belt 16 and upper in-feed belt 36. In a preferred, but non-limiting, embodiment, both lower in-feed belt 16 and upper in-feed belt 36 are surface speed matched in order to provide translational movement of convolutely wound web material 12 through in-feed mechanism 14. Additionally, in a preferred, but not limiting, embodiment, lower in-feed belt 16 is provided as a driven vacuum belt transport where the lower in-feed belt 16 is provided with a plurality of vacuum holes 24 disposed therethrough. Thus, in use, a source of negative pressure can be cooperatively and fluidly associated with lower in-feed belt 16 to provide fluid communication between the source of negative pressure through lower in-feed belt 16 for eventual application to the convolutely wound web material 12 disposed within in-feed mechanism 14. However, one of skill in the art will readily appreciate that upper in-feed belt 36 could also be provided with a plurality of vacuum holes 24 disposed therethrough and a source of negative pressure either alone, or in combination with, lower in-feed belt 16. To those of skill in the art, a sensor (not shown), such as a PEC, could be cooperatively associated with the in-feed mechanism 14 in order to detect the presence of the convolutely wound web substrate 12.

In a preferred embodiment, upon detection of the convolutely wound web substrate 12 within in-feed mechanism 14, the sensor may send a signal that causes the lower in-feed belt 16 of tail sealer apparatus 10 to reverse direction relative to the upper in-feed belt 36 and yet have both lower in-feed belt 16 and upper in-feed belt 36 remain surface-speed matched. In other words, it is preferred that in this position that lower in-feed belt 16 rotate in a direction opposite that of upper in-feed belt 36. However, one of skill in the art would understand and clearly realize that it would also be possible to reverse the upper in-feed belt 36 direction. One of skill in the art will realize that no matter what configuration of belt movement is chosen, lower in-feed belt 16 should rotate in a direction opposite relative to upper in-feed belt 36.

Reversal of the direction of either one of lower in-feed belt 16 or upper in-feed belt 36 causes the convolutely wound web substrate 12 to stop, or reduce, any translational motion through in-feed mechanism 14 and provides for the convolutely wound web substrate 12 to preferably rotate at a fixed location within in-feed mechanism 14. Either during or after any rotation of convolutely wound web material 12 within in-feed mechanism 14, a signal from a sensor could also be used to apply a stream of fluid, such as a gas or air, or can be used to operationally turn on blowers (not shown), to provide such a flow of a fluid stream against the convolutely wound web substrate 12 in a direction preferably generally tangential to the circumference of the convolutely wound web substrate 12. In such an embodiment, the tail portion 48 comprising at least the last sheet disposed upon convolutely wound web substrate 12 is blown away at a direction that is approximately tangential to the circumference of the convulutely wound web substrate 12 by the forces transmitted by such a fluid, gas, or air stream.

Figure 3C:
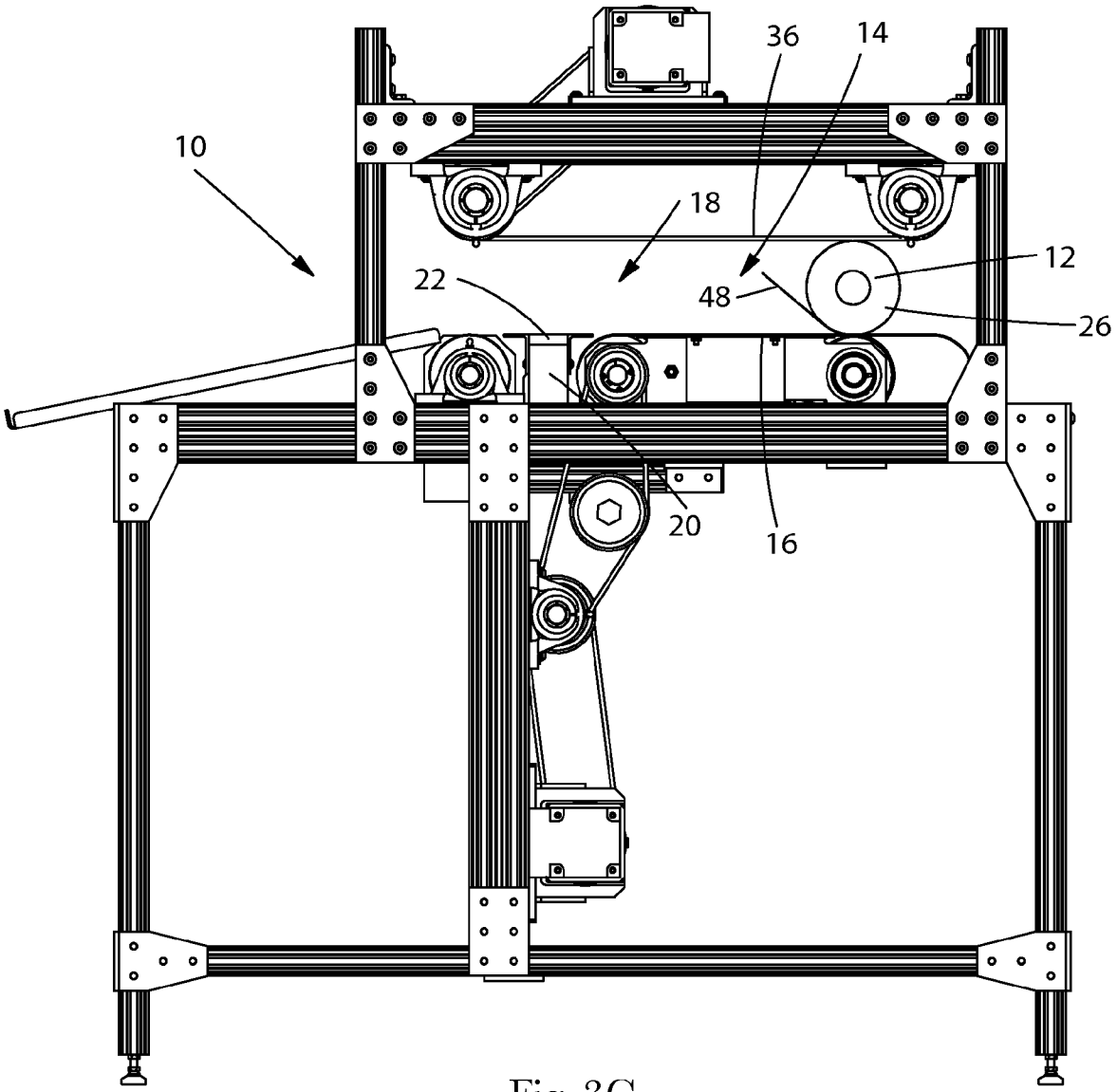
FIG. 3C is an elevational view of the apparatus of FIG. 1 showing continued progression of a convolutely wound web material therethrough.

The application of a fluid stream tangentially to convolutely wound web substrate 12 causes a tail portion 48 comprising at least the last sheet disposed upon the convolutely wound web substrate 12 to be displaced in a direction preferably toward lower in-feed belt 16, as shown in FIG. 3C. It would be desirous that the tail portion 48 be ultimately disposed upon at least a portion of lower in-feed belt 16. However, it would be appreciated by one of skill in the art that in a similar manner, the last sheet disposed upon the convolutely wound web substrate 12 could be displaced in a direction preferably toward upper in-feed belt 36.

Figure 3D:
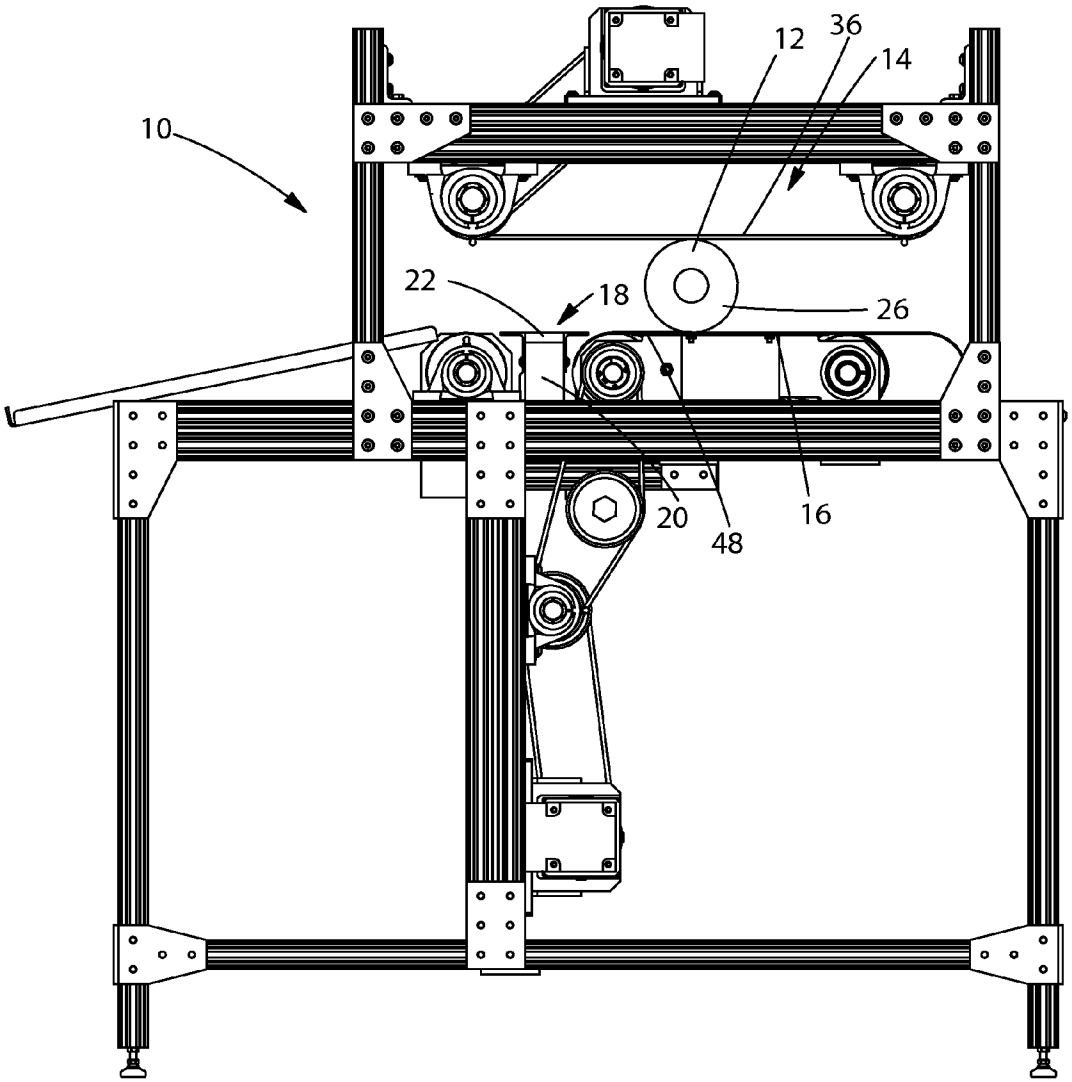
FIG. 3D is an elevational view of the apparatus of FIG. 1 showing continued progression of the convolutely wound web material therethrough.

As shown in FIG. 3D, a sensor (not shown) is preferably positioned in cooperative engagement with lower in-feed belt 16 in order to detect the presence of the tail portion 48 of convolutely wound web substrate 12 against lower in-feed belt 16 as the tail portion 48 of convolutely wound web substrate 12 contacts lower in-feed belt 16. Once the tail portion 48 of convolutely wound web substrate 12 is detected upon lower in-feed belt 16 of in-feed mechanism 14, it is preferred that the tail portion 48 of convolutely wound web substrate 12 be held and/or remain in contacting engagement with lower in-feed belt 16. In a preferred embodiment, a vacuum system (not shown) can provide a source of negative pressure in fluid contact with the convolutely wound web substrate 12 contacting the surface of lower in-feed belt 16 by vacuum holes 24 disposed within lower in-feed belt 16. Thus, the presence of a negative pressure upon the surface of lower in-feed belt 16 through vacuum holes 24 can cooperatively engage the surface of the tail portion 48 of convolutely wound web substrate 12 with lower in-feed belt 16. However, it is not required that a source of negative pressure be used to provide for contacting engagement of the tail portion 48 of convolutely wound web substrate 12 with lower in-feed belt 16. It should be readily appreciated by one of skill in the art that mechanical devices and/or means may be used, including, but not limited to, gravity, static charges, magnets, and the like.

Alternatively, it should be readily realized that the tail portion 48 of convolutely wound web substrate 12 can be held and/or remain in contacting engagement with upper in-feed belt 36. Such an alternative embodiment may require that convolutely wound web substrate 12 be introduced to in-feed mechanism 14 so that the tail portion 48 of convolutely wound web substrate 12 can be presented to upper in-feed belt 36 so that contacting engagement is possible. Such an alternative process may require that convolutely wound web substrate 12 be introduced to the in-feed mechanism 14 in a direction opposite that required for providing contacting engagement of the tail portion 48 of convolutely wound web substrate 12 with lower in-feed belt 16.

Upon the cooperative engagement of the tail portion 48 of convolutely wound web substrate 12 with the surface of lower in-feed belt 16, lower in-feed belt 16 could then be instructed to reverse the direction of travel and speed so that lower in-feed belt 16 is rotating in the same direction and at approximately the same speed as upper in-feed belt 36. When the surface speeds of lower in-feed belt 16 and upper in-feed belt 36 are matched, the convolutely wound web substrate 12 then resumes translational movement through in-feed mechanism 14 of tail sealer apparatus 10.

Figure 3E:
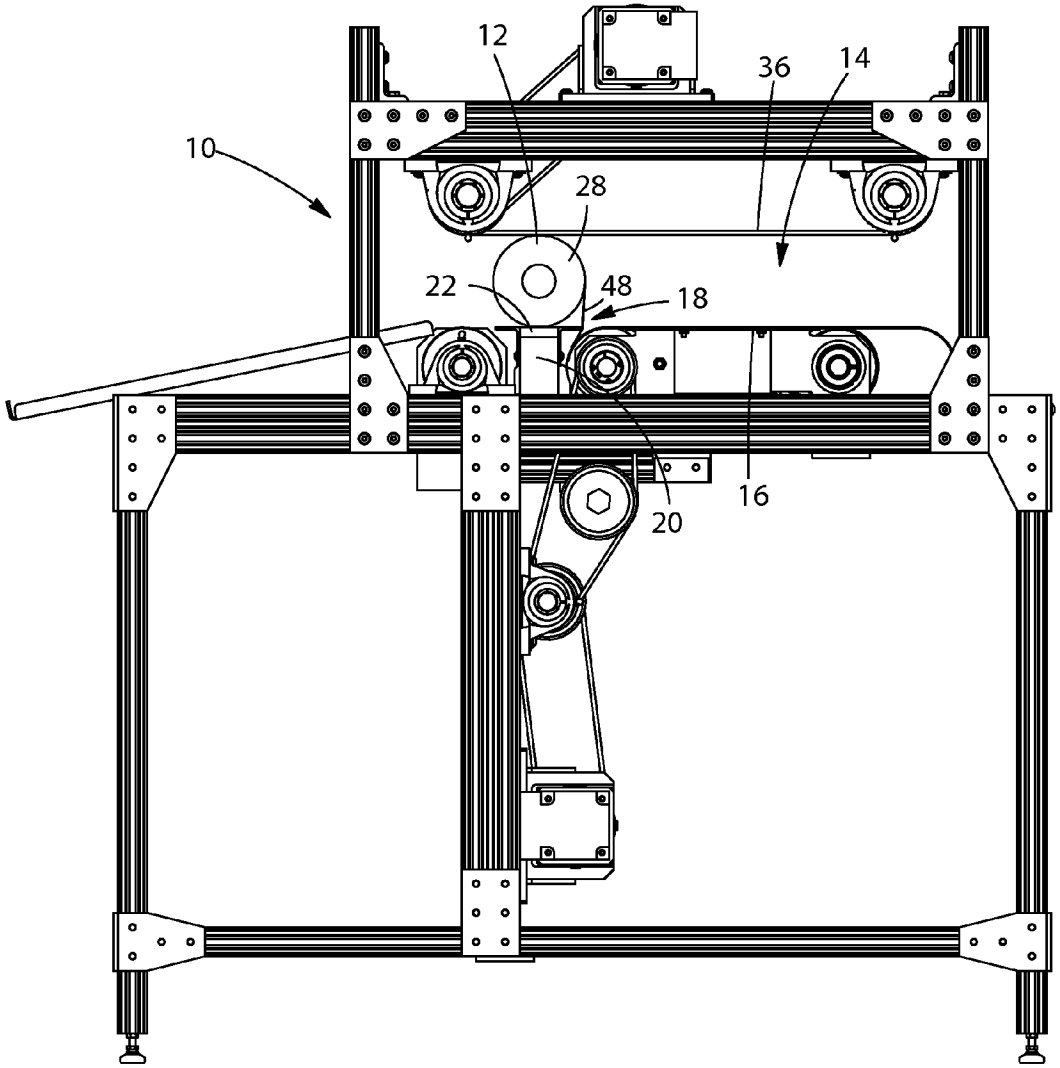
FIG. 3E is an elevational view of FIG. 1 showing adhesive is being disposed upon the convolutely wound web material by an adhesive applicator.

Referring to FIG. 3E, the tail portion 48 of convolutely wound web substrate 12 is preferably held in a fixed position relative to lower in-feed belt 16 as convolutely wound web substrate 12 traverses in-feed mechanism 14. As convolutely wound web substrate 12 becomes proximate to adhesive applicator 18, the tail portion 48 of convolutely wound web substrate 12 can then traverse and be positioned in a direction generally away from, and preferably perpendicular to, the general direction of travel of the remainder of convolutely wound web substrate 12. In other words, the tail portion 48 of convolutely wound web substrate 12 is preferably rotated generally away from and preferably in a generally downward perpendicular direction to that of the plane of translational motion of convolutely wound web substrate 12. In a preferred embodiment, once the tail portion 48 of convolutely wound web substrate 12 is in position, the negative pressure applied to the tail portion 48 of convolutely wound web substrate 12 through the vacuum holes 24 disposed within lower in-feed belt 16 of in-feed mechanism 14 can be released. This can facilitate removal of the tail portion 48 of convolutely wound web substrate 12 from the surface of lower in-feed belt 16. It is in this position that the convolutely wound web substrate 12 can be transported across the applicator surface 22 of, and be provided in contacting engagement with, adhesive applicator 18. As convolutely wound web substrate 12 is transported across applicator surface 22 of adhesive applicator 18, an adhesive disposed within manifold 20 of adhesive applicator 18 is dispensed, or extruded, through apertures disposed within applicator surface 22 of adhesive applicator 18 onto the convolutely wound web substrate 12 at a position on a convolution of convolutely wound web substrate 12 that is immediately subjacent to the tail portion 48 of convolutely wound web substrate 12.

Figure 3F:
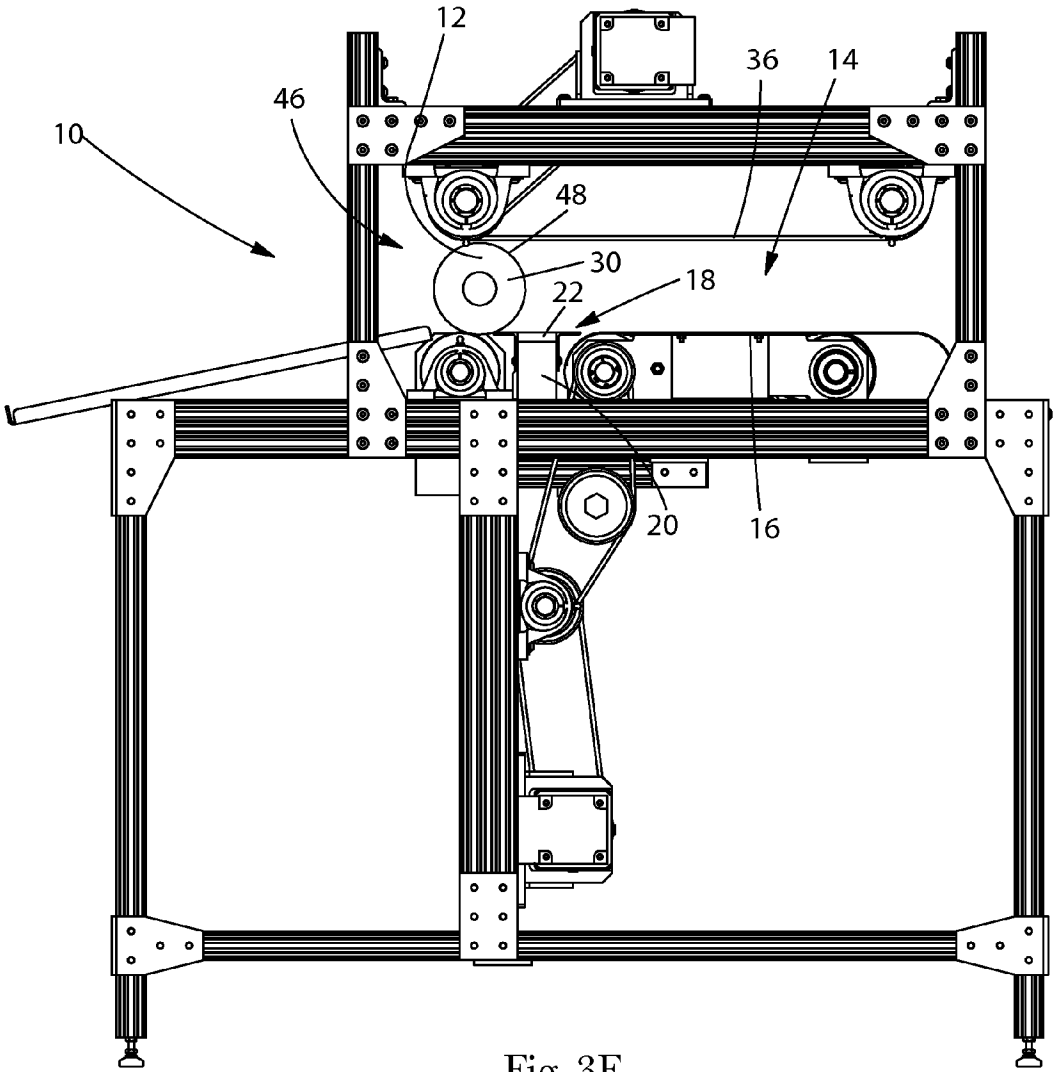
FIG. 3F is an elevational view of the apparatus of FIG. 1 showing progression of the convolutely wound web material after application of an adhesive thereto.

Referring to FIG. 3F, as adhesive is applied to convolutely wound web substrate 12 from adhesive applicator 18, the convolutely wound web substrate 12 may continue and/or resume translational motion through tail sealer apparatus 10 where the convolutely wound web substrate 12 enters a region of compression 46. A region of compression 46 may comprise a region disposed between an upper and lower drive roll. In an exemplary, but non-limiting, embodiment, a lower drive roll may run at a matched surface speed with an upper drive roll but in a direction opposite the direction of rotation of the upper drive roll. This then causes the tail portion 48 of convolutely wound web substrate 12 to be repositioned and/or rewound onto the surface of the convolutely wound web substrate 12. Further, providing an upper and lower drive roller that provide compression to the convolutely wound web substrate 12 can provide a compressive force on the convolutely wound web substrate 12. It was found that such a compressive force upon convolutely wound web substrate 12 can provide efficient sealing of the tail portion 48 to the convolution immediately subjacent thereto. In such a preferred, but non-limiting, embodiment, a sensor can be provided in the region of compression in order to detect the presence of convolutely wound web substrate 12 within the region of compression 46. In a preferred embodiment, once a desired amount of time or a preferred number of rotations of convolutely wound web substrate 12 have occurred, one of the drive rolls can be provided with a signal that stops, reduces the speed of, and/or reverses the direction of that drive roll relative to the other drive roll to cause the convolutely wound web substrate 12 to resume translational motion in order to facilitate an exit from the tail sealer apparatus 10. In any regard, it is preferred that convolutely wound web substrate 12 resume translational motion to exit tail sealer apparatus 10 by any means known to those of skill in the art, such as a pusher bar, discharge bar, manually, and the like.

Figure 3G:
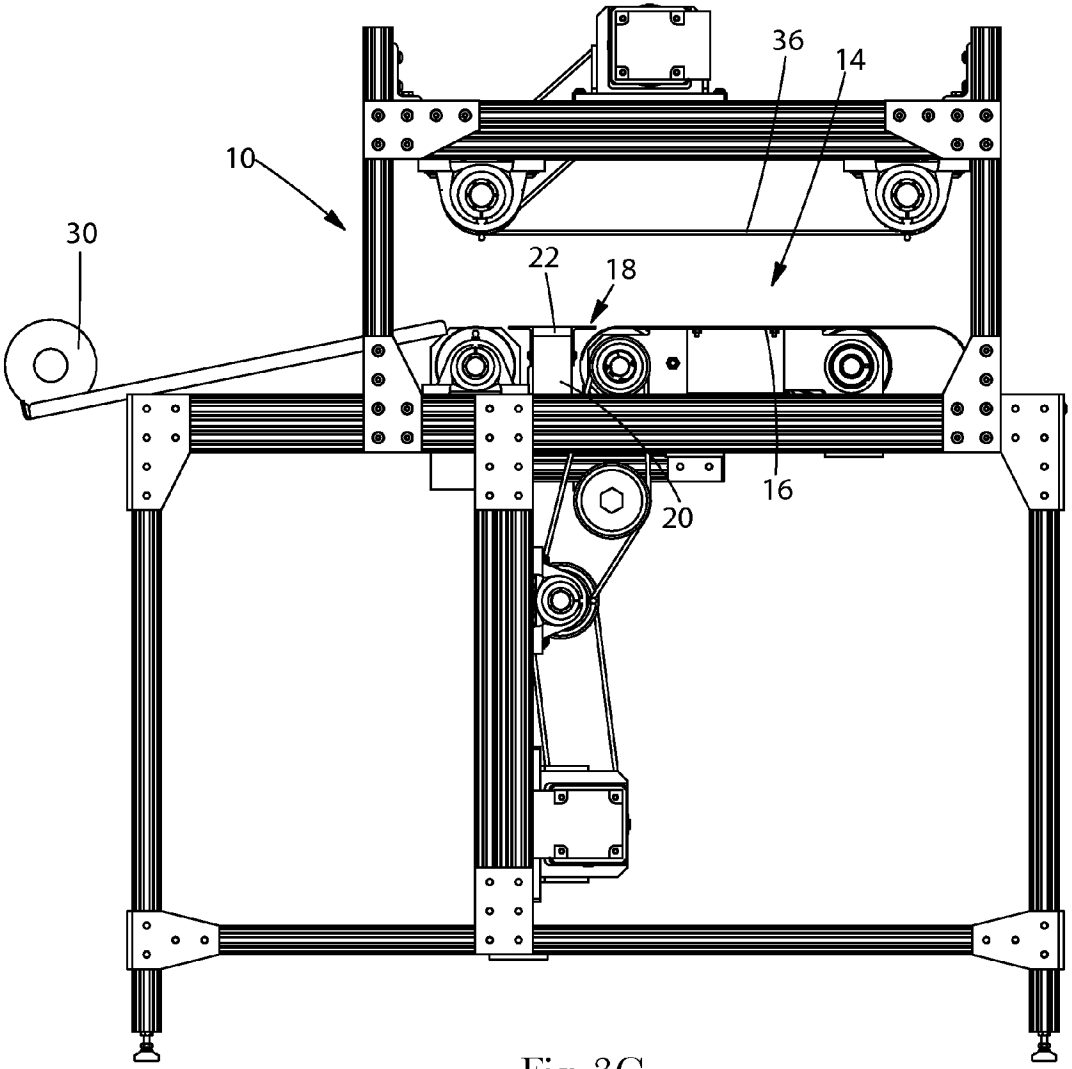
FIG. 3G is an elevational view of the apparatus of FIG. 1 showing the convolutely wound web material exiting the adhesive sealing apparatus.

Referring to FIG. 3G, the convolutely wound web substrate 12 having a tail portion 48 adhesively attached to an immediately subjacent convolution and now forming finally sealed convolutely wound web substrate 30 can be directed away from tail sealer apparatus 10 for further processing as may be required. A new convolutely wound web substrate 12 may then be introduced into in-feed mechanism 14 of tail sealer apparatus 10 to repeat the process thereon that consummates in the tail portion 48 of the new convolutely wound web substrate 12 being secured to an immediately subjacent convolution.

As shown in FIGS. 4-11*a*, the adhesive applicator 18 of the tail sealer apparatus 10 can be provided with a manifold 20 (having a plurality of designs) that is slightly wider than the width of the convolutely wound web substrate 12. It is believed that providing a manifold 20 in such a manner can facilitate gluing of the tail portion 48 of the convolutely wound web substrate 12 to an immediately subjacent convolution. Additionally, a preferred embodiment of the tail sealer apparatus 10 incorporates the use of an applicator surface 22 that can be fixedly secured to the portion of the manifold 20 that is ultimately proximate to convolutely wound web substrate 12 during use of the tail sealer apparatus 10. Such an applicator surface 22 can be secured to the manifold 20 of adhesive applicator 18 using techniques known to those of skill in the art. Such techniques can include, but not be limited to, the use of bolts, machined grooves, dovetailed slides, combinations thereof, and the like. Such attachment can provide for the rapid change-over of individual applicator surfaces 22 upon manifold 20 as required. In a preferred embodiment, the applicator surface 22 of the instant invention may be provided with a pattern of holes that provide fluid communication between the surface of applicator surface 22 and the inner portions of manifold 20 of adhesive applicator 18. Such holes can be provided in any desired pattern and in any combination of the machine and cross-machine direction common to convolutely wound web substrate 12. The manifold 20 of adhesive applicator 18 is generally provided with one or more orifices and/or openings wherein an appropriate glue and/or fluid to be applied to convolutely wound web substrate 12 can be disposed therethrough. The present invention was surprisingly found to be able to provide multi-directional glue patterns upon a convolutely wound web substrate 12 that can provide decorative or additional functional requirements as required to convolutely wound web substrate 12. This is a stark difference from the single dimension (typically cross-machine direction) capabilities of the tail sealing apparatuses available in the prior art. Additionally, it was surprisingly found that a wide range of viscosities of fluids were compatible with the instant invention. In use it is believed that fluids having low viscosities (i.e., 0 cP-10 cP) to relatively high viscosities (i.e., 20,000 cP-30,000 cP) were compatible with the instant tail sealer apparatus 10. However, it is believed that the practical limit of the tail sealer apparatus 10 of the instant invention is limited to the ability of a pumping system to feed a fluid to the manifold 20 of tail sealer apparatus 10.

In a preferred embodiment, adhesive applicator 18 can be provided with fluid communication to convolutely wound web substrate 12 with a high precision pump not shown, such as a gear pump, that is capable of supplying adhesive or other desired fluid into manifold 20 of adhesive applicator 18 at a desired rate. The fluid communication of an adhesive or other fluid into the interior of manifold 20 of adhesive applicator 18 can utilize a motor to rotate such a pump at a constant speed or may change the speed of the motor to change the pump speed. Further, such a desirable pump assembly can be provided with a valve that opens and closes at a desired time and/or for a desired length of time that can provide for the communication of adhesive or other fluid to the interior of manifold 20 of adhesive applicator 18. Such a valve assembly can incorporate the use of sensors and/or controllers.

By way of non-limiting example, the process of application of adhesive or other fluid to a convolutely wound web substrate 12 is preferably monitored, thereby providing a signal sent to an exemplary controller that opens and closes the valve cooperatively associated with adhesive applicator 18. In a preferred embodiment of the instant invention, such a valve may be opened and/or closed based upon the presence of the tail portion 48 of the convolutely wound web substrate 12 at a desired, calculated, and/or certain position with respect to the tail sealer apparatus 10. Further, such a valve may be opened and/or closed as required based upon the viscosity of the adhesive and/or fluid to be applied to convolutely wound web substrate 12. Such other variables effecting the valve open and close rate can incorporate the turn-over rate of the process for producing convolutely wound web substrate 12 and/or any other externally sensed input into the tail sealer apparatus 10 system. Other exemplary or non-limiting variables suitable for use with the instant invention can also include visual observation or timing with other equipment, either upstream or downstream, with respect to the processing of convolutely wound web substrate 12. Additionally, tail sealer apparatus 10 could be adapted to work with only a pump that directly applies the adhesive and/or fluid to convolutely wound web substrate 12.

A pump assembly suitable for use with the instant adhesive applicator may have a reservoir cooperatively and fluidly associated thereto from which the glue and/or other fluid to be ultimately applied to convolutely wound web substrate 12 is drawn and sent to the manifold 20 of adhesive applicator 18. Such a pump assembly may also incorporate the use of a by-pass valve that is capable of recirculating such an adhesive and/or other fluid when an output valve in the pump assembly is closed. Such a suitable by-pass valve can be provided with a variable pressure set point so that the glue and/or other fluid could be by-passed through the system at a desired pressure set point. Preferably, such a recirculation system is provided as a closed loop in order to prevent contaminants from entering the fluid stream of the adhesive and/or other fluid to be applied to convolutely wound web substrate 12.

Figures 4, 4A, 5, 5A:
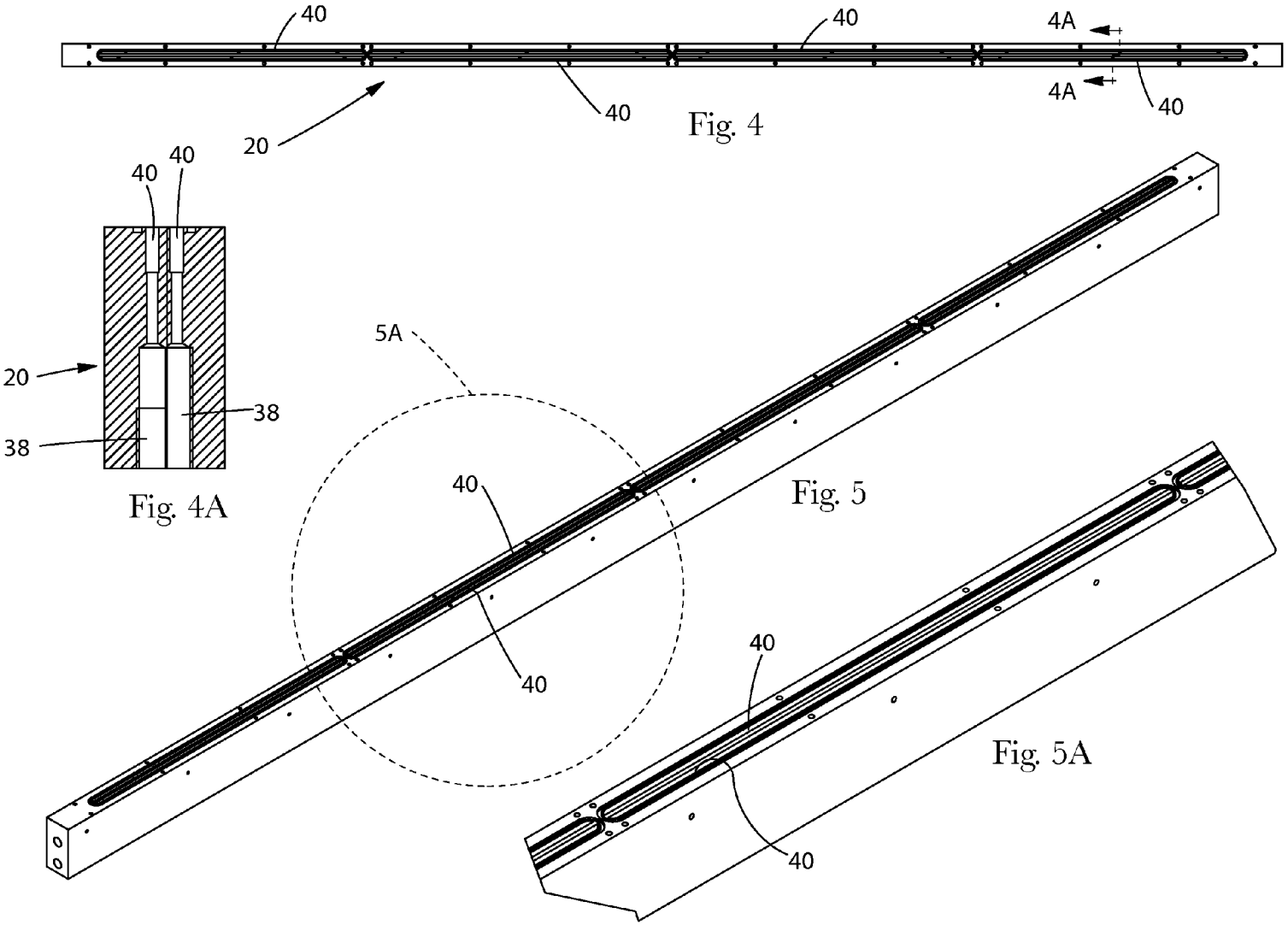
FIG. 4 is a plan view of a manifold suitable for use with an adhesive applicator of the present invention.
FIG. 4A is a sectional view taken along the line 4A-4A of FIG. 4.
FIG. 5 is a perspective view of the manifold of FIG. 4.
FIG. 5A is an enlarged view of the region labeled 5A of FIG. 5.
Figures 6, 6A, 7, 7A:
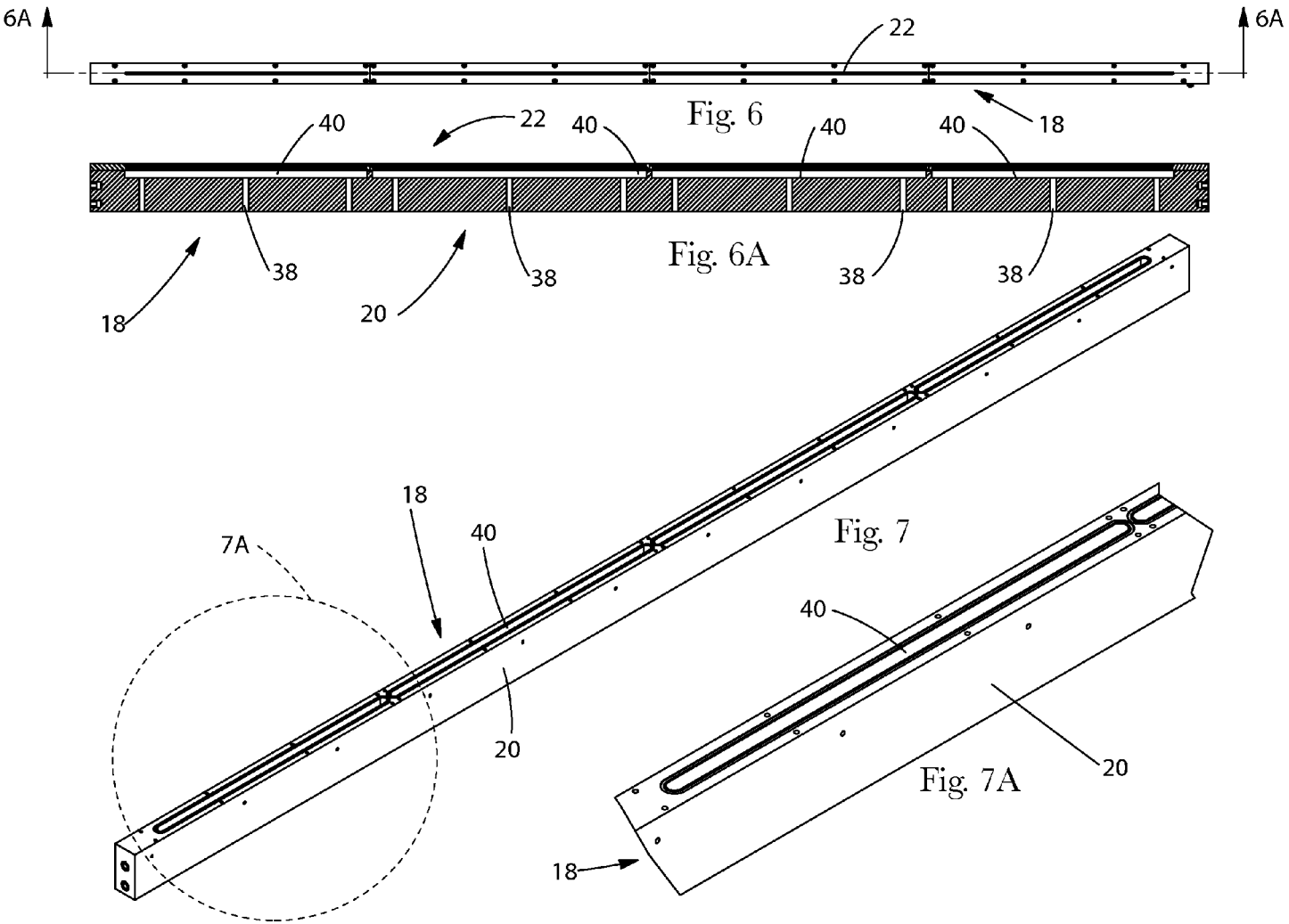
FIG. 6 is a plan view of an adhesive applicator suitable for use with the present invention.
FIG. 6A is a sectional view taken along the line 6A-6A of FIG. 6.
FIG. 7 is a perspective view of an alternative embodiment of a manifold.
FIG. 7A is an expanded view of the region labeled 7A in FIG. 7.
Figures 8, 8A, 9, 9A:
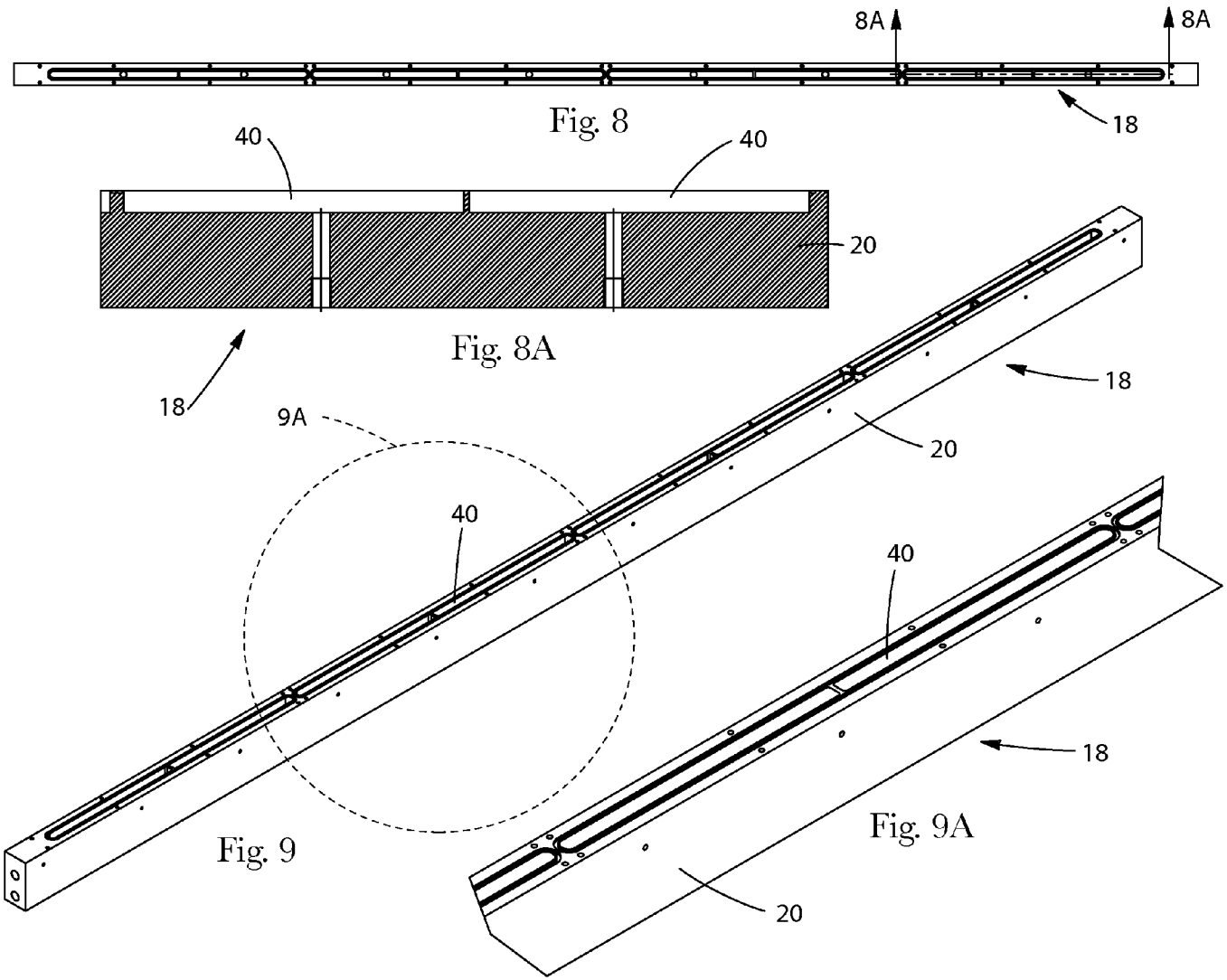
FIG. 8 is a plan view of an alternative embodiment of a manifold.
FIG. 8A is a sectional view taken along the line 8A-8A of FIG. 8.
FIG. 9 is a perspective view of the manifold of FIG. 8.
FIG. 9A is an expanded view of the region labeled 9A of FIG. 9.

As shown in FIGS. 4, 4*a*, 5, and 5*a*, an exemplary manifold 20 suitable for use with adhesive applicator 18 associated with tail sealer apparatus 10 can be provided with a plurality of manifold passageways 38. This is believed desirable when the plurality of manifold passageways 38 are cooperatively associated with an applicator surface 22 when the applicator surface 22 is fixedly attached to manifold 20. In this manner, it would be possible to provide for a plurality of different adhesives and/or fluids and/or combinations thereof to be cooperatively associated with a respective manifold passageway 38 for ultimate application and deposition of the adhesives and/or fluids and/or combinations thereof upon convolutely wound web substrate 12. As shown in FIGS. 4 and 4*a*, such manifold passageways 38 can be provided in the form of an opening or openings, including but not limited to, holes and/or slits extending along the longitudinal axis of manifold 20 and extending in the cross-machine direction of convolutely wound web substrate 12. This could provide the surprising benefit of facilitating the application of different adhesives and/or fluids which may incorporate different adhesive properties, different fluid properties, different colors, or any other desired property of such an adhesive and/or fluid, and the like to different regions and/or portions of convolutely wound web substrate 12.

It should be readily realized by one of skill in the art that the incorporation of a heating and/or cooling system in cooperative engagement with adhesive applicator 18 is also possible with the current invention. Thus, if the end user requires heat to be applied to the fluid disposed within manifold 20 and/or applicator surface 22 in order to effectuate the sealing process upon convolutedly wound web substrate 12, such is now possible by the incorporation of a heating element or the deposition of heat from a remote source to the fluid disposed within manifold 20 and/or applicator surface 22. Similarly, if cooling of the fluid disposed within manifold 20 and/or applicator surface 22 is required, a cooling element or energy from a remote source can be applied to the fluid disposed within manifold 20 and/or applicator surface 22. Further, manifold 20 and/or applicator surface 22 can be disposed within a system that provides a jacket or envelope, that surrounds, manifold 20 and/or applicator surface 22. A fluid can be disposed between manifold 20 and/or applicator surface 22 and any jacket provided therefor in order to provide for, or increase, the specific heat transfer from any such jacket or envelope to manifold 20 and/or applicator surface 22.

Referring to FIGS. 6, 6A, 7, 7A, 8, 8A, 9, 9A, and 10, manifold 20 of adhesive applicator 18 can be provided with a plurality of manifold passageways 38 extending parallel to the longitudinal axis of manifold 20 and generally in the cross-machine direction of convolutely wound web substrate 12. This can facilitate the provision of a plurality of collective regions 40 within manifold 20 that provide regions that are disposed in the cross-machine direction of convolutely wound web substrate 12. Providing for collective regions 40 spaced in the cross-machine direction of convolutely wound web substrate 12, can facilitate the differential application of adhesive and/or fluids to convolutely wound web substrate 12 in the cross-machine direction. In other words, a first adhesive and/or fluid can be provided to one portion of convolutely wound web substrate 12 at a first position, and a second position of convolutely wound web substrate 12 distal thereto can be provided with a different adhesive and/or fluid to provide the desired properties to convolutely wound web substrate 12. Additionally, providing collective regions 40 spaced in the cross-machine direction of convolutely wound web substrate 12 can facilitate the incorporation of various applicator surfaces 22 having slits, holes, ports, patterns, and/or other designs cooperatively associated thereto that can provide for the fluid communication of such adhesive and/or fluid from the manifold 20 to the surface of applicator surface 22, as required.

Figure 11:
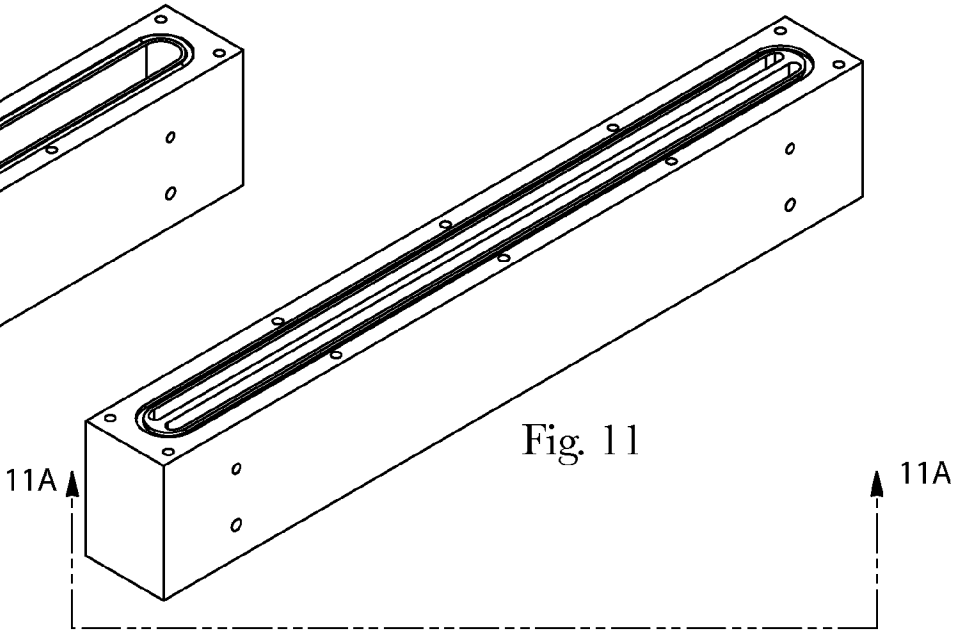
FIG. 11 is a perspective view of yet another alternative embodiment of a manifold.
Figure 11A:
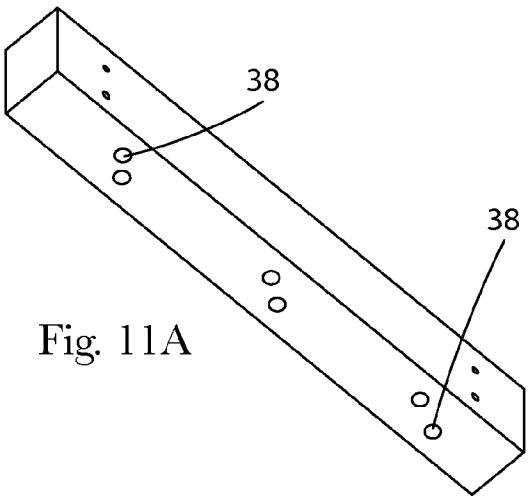
FIG. 11A is a perspective view of the manifold of FIG. 11 taken along the line 11A-11A.
Figure 10:
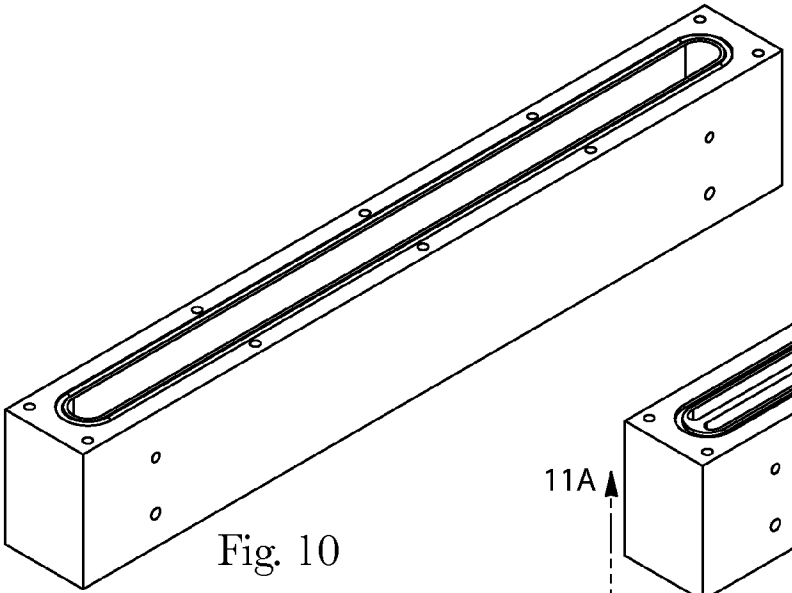
FIG. 10 is a perspective view of another alternative embodiment of a manifold.

Referring to FIGS. 11, and 11A, providing for collective regions 40 spaced in the machine direction of convolutely wound web substrate 12 can facilitate the differential application of adhesive and/or fluids to convolutely wound web substrate 12 in the machine direction. In other words, a first adhesive and/or fluid can be provided to one portion of convolutely wound web substrate 12 at a first position, and a second position of convolutely wound web substrate 12 spaced sequentially thereto in the machine direction can be provided with a different adhesive and/or fluid to provide the desired properties to convolutely wound web substrate 12. Additionally, providing collective regions 40 spaced in the machine direction of convolutely wound web substrate 12 can facilitate the incorporation of various applicator surfaces 22 having slits, holes, ports, patterns, and/or other designs cooperatively associated thereto that can provide for the fluid communication of such adhesive and/or fluid from the manifold 20 to the surface of applicator surface 22, as required.

Referring to FIGS. 12-17, troughs 42 disposed within applicator surface 22 cooperatively associated with manifold 20 of adhesive applicator 18 can provide for a form of collection reservoir wherein the adhesive and/or fluid to be disposed upon convolutely wound web substrate 12 can be collected prior to application thereto. As a suitable adhesive and/or fluid is pumped into manifold 20 and is fluidly communicated to applicator surface 22 of adhesive applicator 18 prior to deposition of such adhesive and/or fluid to convolutely wound web substrate 12, the adhesive and/or fluid can be disposed within troughs 42 without the need for recirculating any such excess or overflow adhesive and/or fluid back into the pump system supplying such adhesive and/or fluid to adhesive applicator 18. Troughs 42 can circumscribe one or a plurality of fluid pathways 44 in any direction relative to the longitudinal axis of manifold 20. Additionally, troughs 42 can be disposed within applicator surface 22 as a machined valley or provided as individual counter-sunk 'divots' disposed about fluid pathways 44 disposed within applicator surface 22. Likewise, troughs 42 can be collectively elongate and/or discreet in any direction relative to the longitudinal axis of manifold 20.

Figure 12:
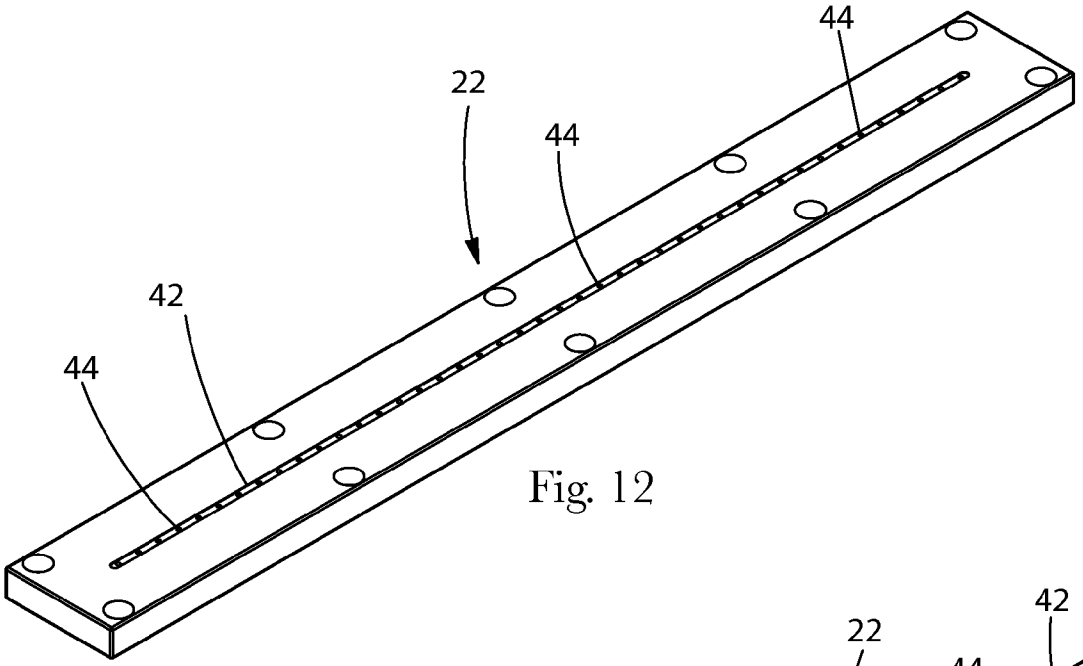
FIGS. 12-17 are exemplary embodiments of applicator surfaces.
Figure 13:
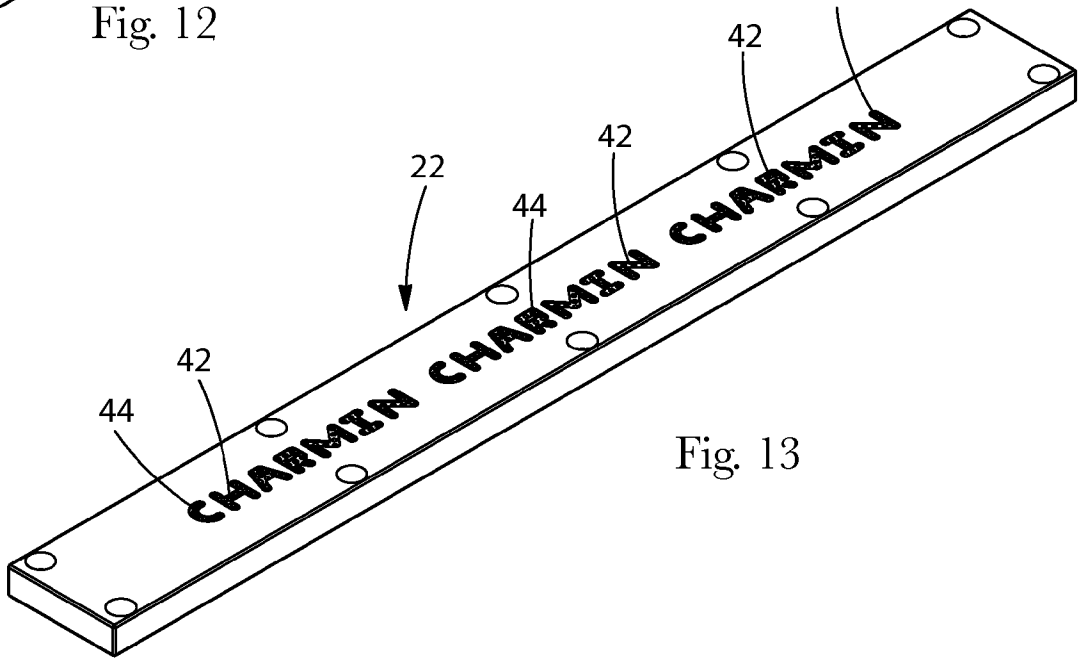
Figure 14:
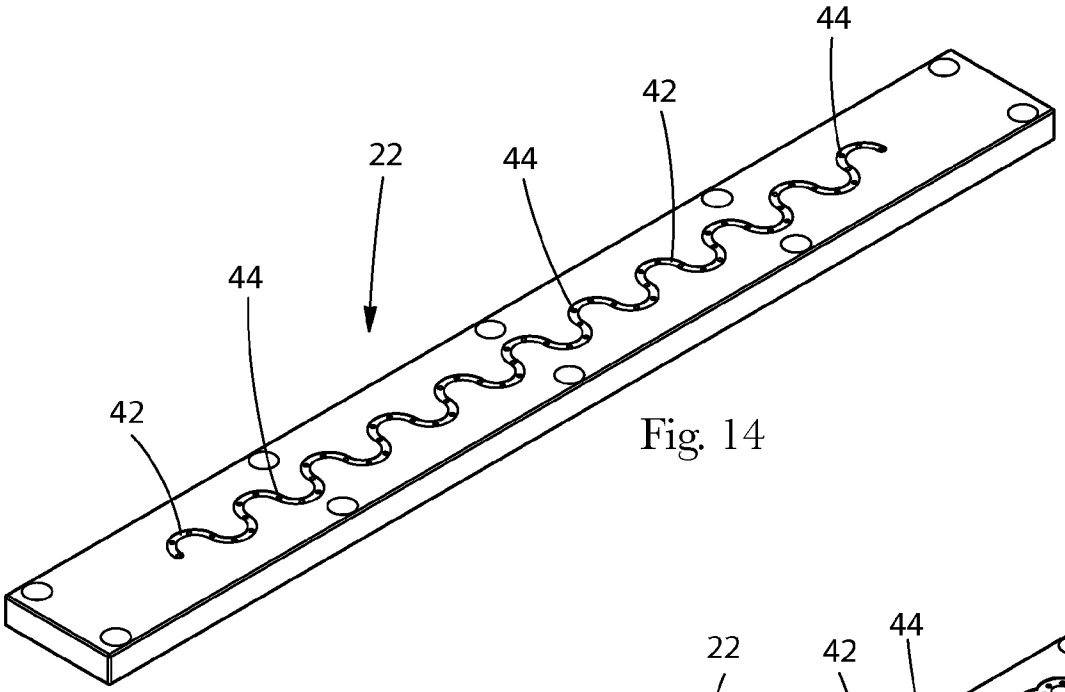

Referring again to FIGS. 12-17, one of skill in the art can readily recognize that applicator surfaces 22 that are manufactured integrally with cooperatively, removeably, and/or fixedly associated with manifold 20 of adhesive applicator 18 can be provided with any desired design and/or shape as may required to place the desired amount of adhesive and/or fluid upon convolutely wound web substrate 12. Such designs can incorporate components in both the machine and cross-machine directions of convolutely wound web substrate 12. While one of skill in the art will readily recognize the linear pattern shown in FIG. 12 as one of typical usage with currently commercially available tail sealer apparatuses, a much more flexible and adaptable system is provided by way of the instant invention. As can be seen, the applicator surface 22 is provided with a plurality of fluid pathways 44 that are disposed within troughs 42. Adhesives and/or fluids can be fluidly communicated from the manifold 20 by way of fluid pathways 44 into the troughs 42 of each applicator surface cooperatively associated with manifold 20. Such combinations of fluid pathways 44 and troughs 42 can be provided as a traditional linear glue path pattern upon convolutely wound web substrate 12, as shown in FIG. 12. However, should the end user desire to associate product branding or other commercially relevant information with an application of glue to a convolutely wound web substrate 12, fluid pathways 44 and troughs 42 can be provided to communicate such brand information, as shown by the applicator surface 22 depicted in FIG. 13. Likewise, it would be possible to increase the area upon which such an adhesive and/or fluid is disposed upon convolutely wound web substrate 12 by the incorporation of additional machine direction components to such a glue pattern. In this manner, it should be readily apparent to one of skill in the art that the addition of a machine direction component to the glue pattern disposed upon convolutely wound web substrate 12 could facilitate the need for an adhesive or other fluid having less tackiness but spread over a greater distance to provide for the same or better adhesion of the tail portion 48 of the convolutely wound web substrate 12. Securing the tail portion 48 of a convolutely wound web substrate 12 in this manner to the immediately subjacent convolution could provide for easier removal of such tail portion 48 section from the convolutely wound web substrate 12 while still maintaining a desirable seal.

Figure 15:
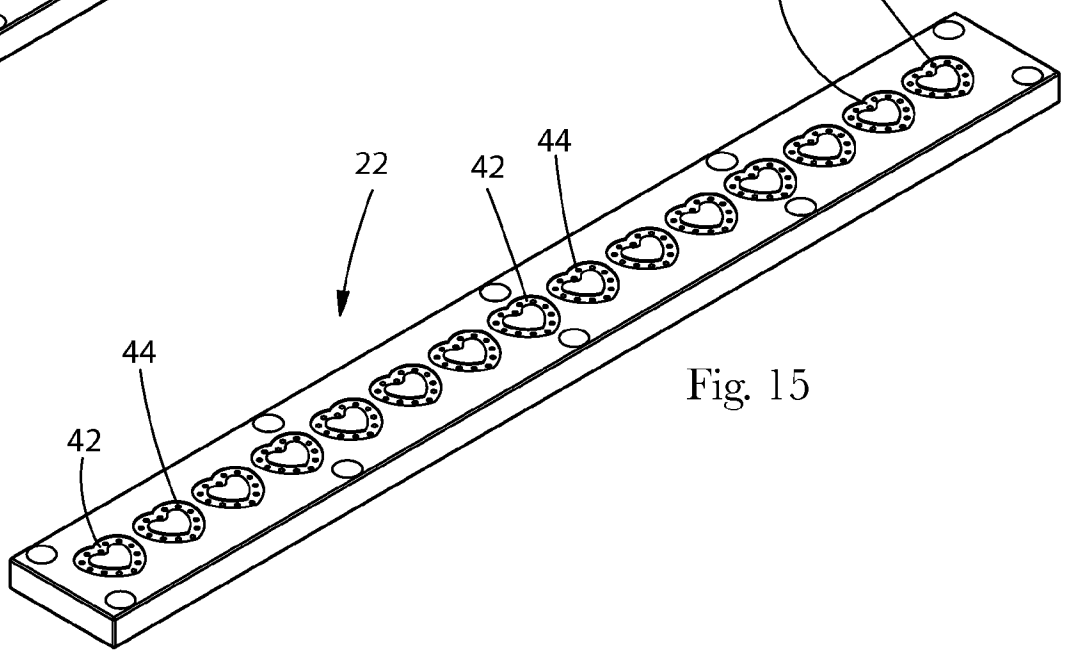

As shown in FIG. 15, the fluid pathways 44 and troughs 42 of applicator surface 22 can be provided in decorative patterns including, but not limited to, hearts, stars, moons, houses, combinations thereof, and the like in order to convey seasonal and/or mood oriented patterns upon convolutely wound web substrate 12. Further, providing an adhesive and/or fluid that is ultimately disposed upon convolutely wound web substrate 12 with a variety of opacities can further enhance the seasonal and/or mood desired enhancements associated with convolutely wound web substrate 12. By way of example, the deposition of red and green adhesives to convolutely wound web substrate 12 in the form of a holiday pattern could provide for such a seasonal convolutely wound web substrate 12 that can be readily observed by the consumer.

Figure 16:
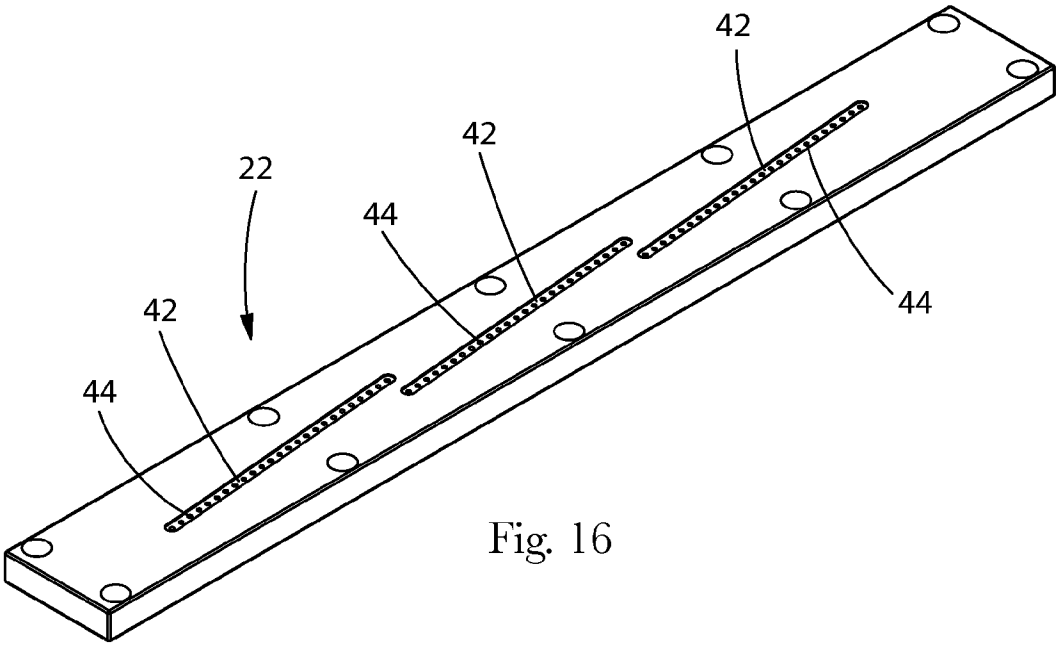
Figure 17:
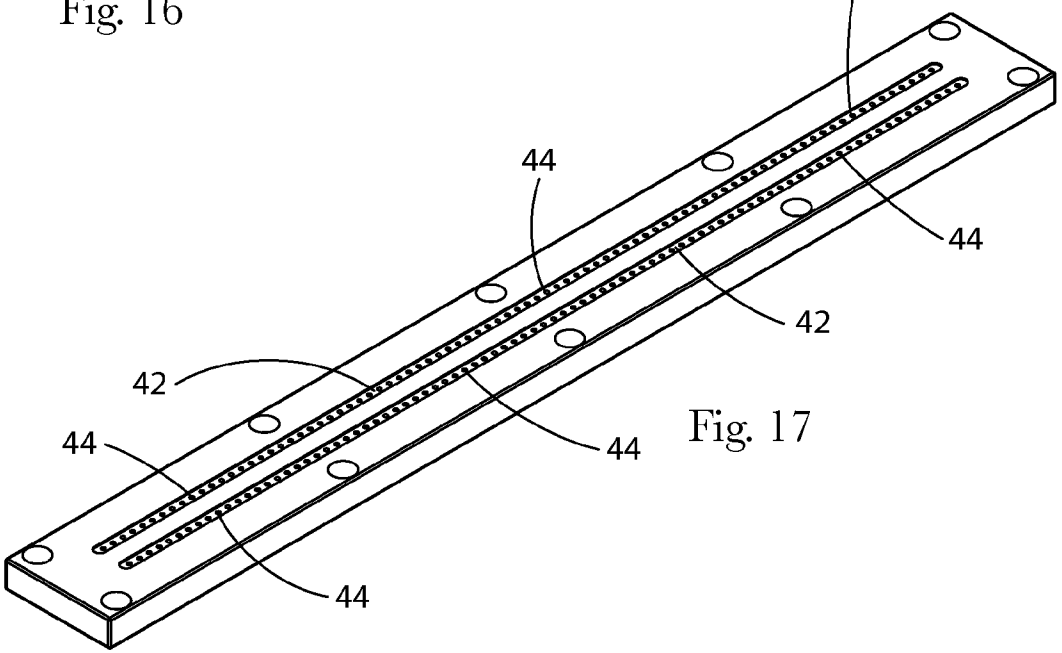

Similarly, as shown in FIGS. 16 and 17, the fluid pathways 44 and troughs 42 cooperatively associated with applicator surface 22 can be provided in virtually an infinite number of patterns as desired by the end user. Such patterns can be discontinuous and incorporate both machine direction and cross-machine direction components, as shown in FIG. 16. Similarly, and as shown in FIG. 17, a plurality of machine direction spaced troughs 42 and fluid pathways 44 can facilitate the application of additional adhesive and/or fluid to convolutely wound web substrate 12, as required. Such a pattern could provide for increased sealing capability for convolutely wound web substrates 12 that are resistant to winding or have a low bend modulus (such as sheet steel).

Tail sealer apparatus 10 has been surprisingly found to reduce the maintenance required of most commercially available tail sealing systems. One of skill in the art will appreciate that the placement of a cover upon the surface of applicator surface 22 having fluid pathways 44 disposed therein will provide sufficient sealing and thereby prevent the crystallization of any fluid disposed therein and/or thereon. It was found that the deposition of a small amount of fluid upon applicator surface 22 was sufficient to provide a sealing surface between applicator surface 22 and such a cover. This can be beneficial to the end user in that it is now not necessary to purge a tail sealing system of excess fluid. Thus, material waste is reduced and/or eliminated and clean-up of such a system is not necessarily required and plugging of the fluid pathways 44 is reduced and/or eliminated. Likewise, it was surprisingly found that it was not necessary to run fluid through the tail sealer apparatus 10 on days when the tail sealer apparatus 10 was not in use.

Figure 21:
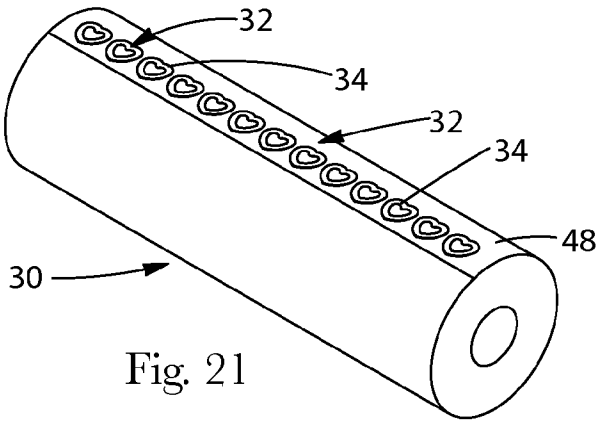
FIGS. 18-22 are exemplary embodiments of convolutely wound web materials having indicia, visible or otherwise, disposed thereon by a tail sealing apparatus.
Figure 22:
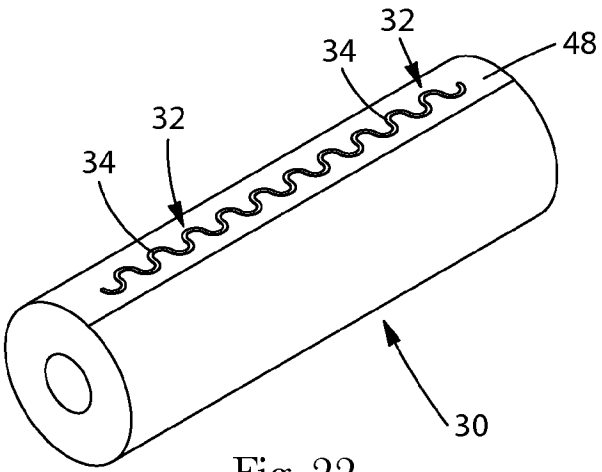
Figure 18:
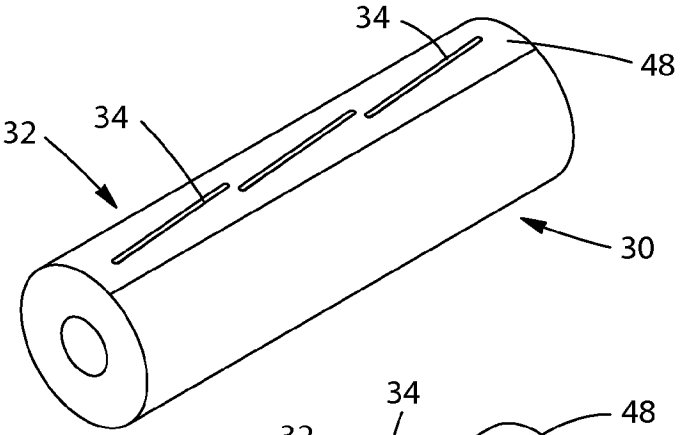
Figure 19:
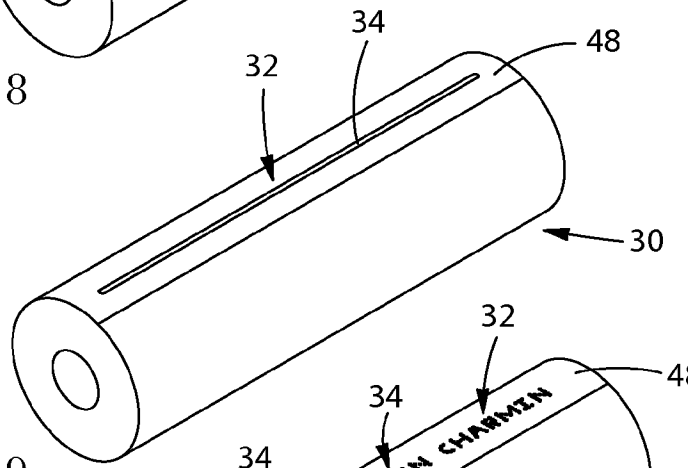
Figure 20:
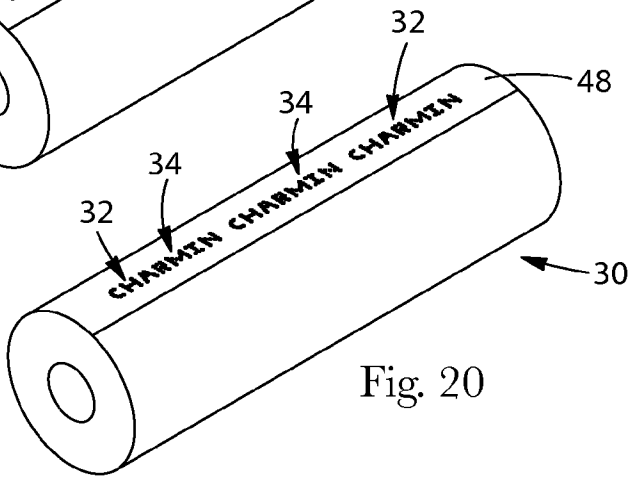

FIGS. 18-22 depict different finally sealed convolutely wound web substrates 30 having a variety of glue seals 32 and indicia 34 disposed thereon and/or observable therethrough. As used herein, observable is meant in reference to seeing or sensing and can include the senses of sight, touch, and smell. As discussed supra, the deposition of adhesive and/or other fluid in the form of indicia 34 upon finally sealed convolutely wound web substrate 30 can communicate brand information and provide for additional reinforcement of the consumer's intent to purchase such convolutely wound web substrate 12 having the required and/or desired indicia 34 disposed thereon. By way of non-limiting example, as shown in FIG. 20, brand information and/or reinforcement in the form of indicia 34 of a well known toilet tissue product can provide the consumer with assurance of originality and quality of a known bath tissue product. Likewise, providing indicia 34 upon convolutely wound web substrate 12 to form finally sealed convolutely wound web substrate 30, can also provide for a decorative appearance of such finally sealed convolutely wound web substrate 30 that the consumer finds appealing. For example, during known holidays and/or occasions, such indicia 34 can be provided in order to reinforce the holiday communication and/or provide for thematic representation of such indicia suitable for use with the given holiday and/or occasion. By way of non-limiting example, as shown in FIG. 21, indicia 34 can be provided as red hearts to remind the consumer and/or final purchaser of the Valentine's Day holiday. Similarly, indicia 34 can be provided in the form of single or multi-colored Christmas trees and/or other holiday ornamentation to remind the consumer and/or provide thematic representation and coordination for the Christmas season. Similarly, such indicia 34 can be provided to coordinate with a known business enterprise. As shown in FIG. 18, the deposition of adhesive and/or fluid upon convolutely wound web substrate 12 as multi-colored stripes forming indicia 34 could be suitable for use in barber shops or other venues where swirled stripes are typically presented upon known business indicia. Thus, the indicia 34 can be provided in a succeeding pattern of red, white, and blue stripes to communicate the fact that the finally sealed convolutely wound web substrate 30 was made specifically for a barber shop or perhaps even with respect to political conventions and/or national holidays where red, white, and blue stripes provide a common linkage thereto. Likewise, the glue seals 32 and indicia 34 can be designed to allow for the differential application of fluid to the convolutedly wound web substrate 12. Such design elements can account for and/or remedy the occurrence of tail portion 48 'fly-ups' and other processing anomalies. Likewise, the design elements can provide for 'gaps' in the glue seals 32 and indicia 34 that can allow for a consumer to grab the tail portion 48 in the event of a mis-registration of the glue seals 32 and indicia 34 upon convolutedly wound web substrate 12.

In any regard, the embodiments shown are not intended to provide limitations for the application of adhesive to a convolutely wound web substrate 12 to form a finally sealed convolutely wound web substrate 30. It should be realized by those of skill in the art that any pattern desired by the end user can be provided hereto. It should also be readily realized that the application of an adhesive or other fluid to a convolutely wound web substrate to bind a tail portion 48 cooperatively associated thereto to an immediately subjacent convolution in a manner that provides flexibility and/or any other benefits than those tail sealers commercially available to manufacturers of such finally sealed convolutely wound web substrates provides for an added degree of flexibility.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The dimensions and/or numerical values disclosed herein are not to be understood as being strictly limited to the exact dimensions and/or numerical values recited. Instead, unless otherwise specified, each such dimension and/or numerical value is intended to mean both the recited dimension and/or numerical value and a functionally equivalent range surrounding that dimension and/or numerical value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. it is therefore intended to cover in the appended claims all such changes and modifications that are within the scope of this invention.

What is claimed is:

1. An apparatus for applying a fluid to a convolutely wound roll of a web substrate, said apparatus comprising:

a fluid applicator, said fluid applicator comprising a manifold and a first surface, said manifold being cooperatively and fluidly connected to a reservoir for containing said fluid, said fluid being conveyable from said reservoir to said manifold with a pump assembly provided in fluid communication with a closed loop recirculation system, said closed loop recirculation system disposing said fluid into said manifold;

said fluid being fluidly displaceable from said manifold to said first surface through at least one opening disposed therein;

wherein at least a portion of said fluid is fluidly displaced from said first surface to said convolutely wound roll of web substrate when said convolutely wound roll is placed into contacting engagement therewith; and, wherein said closed loop recirculation system prevents any of said fluid not fluidly displaced from said first surface to said convolutely wound roll of web substrate from displacement back into said manifold.

2. The apparatus according to claim 1, wherein said convolutely wound roll of web substrate has a first portion and a second portion, said second portion comprising an end of said convolutely wound roll of web substrate, said apparatus fluidly displacing said fluid upon said first portion.

3. The apparatus according to claim 2, wherein said apparatus overlays said second portion over said first portion.

4. The apparatus according to claim 3, wherein said apparatus further comprises a means for unwinding said second portion from said convolutely wound roll.

5. The apparatus according to claim 4, further comprising means for winding said second portion upon said convolutely wound roll of web substrate.

6. The apparatus according to claim 1, wherein said convolutely wound roll of web substrate has a first portion and a second portion, said second portion comprising an end of said convolutely wound roll of web substrate, said apparatus fluidly displacing said fluid upon said second portion.

7. The apparatus according to claim 1, wherein said fluid applicator is movable relative to said convolutely wound roll of web substrate.

8. The apparatus according to claim 7, wherein said first surface is movable relative to said convolutely wound roll of web substrate.

9. The apparatus according to claim 1, wherein said manifold fluidly disposes said fluid upon said convolutely wound roll of web substrate in a pattern.

10. The apparatus according to claim 9, wherein said first surface further comprises troughs disposed thereon, said at least one of said openings being disposed within at least one of said troughs.

11. An apparatus for sealing the tail of a convolutely wound roll of web substrate to the convolutely wound roll of web substrate with an adhesive, said apparatus comprising:

an adhesive applicator;

wherein said adhesive applicator comprises a manifold and a first surface, said manifold being cooperatively and fluidly connected to a reservoir for containing said adhesive, said adhesive being conveyable from said reservoir to said manifold with a pump assembly provided in fluid communication with a closed loop recirculation system, said closed loop recirculation system disposing said adhesive into said manifold, said adhesive being fluidly displaceable through said applicator from said manifold to said first surface through at least one opening disposed therein;

wherein at least a portion of said adhesive disposed upon said first surface is transferable to said convolutely wound roll of web substrate when said convolutely wound roll is disposed upon said first surface; and, wherein said closed loop recirculation system prevents any of said adhesive not transferred to said convolutely wound roll of web substrate from displacement back into said manifold.

12. The apparatus according to claim 11, wherein said apparatus further comprises an in-feed mechanism cooperatively associated with said adhesive applicator, said convolutely wound roll of web substrate being disposed upon said in-feed mechanism, said in-feed mechanism conveying said convolutely wound roll of web substrate proximate to said adhesive applicator.

13. The apparatus according to claim 12, said in-feed mechanism further comprising a source of negative pressure in fluid communication with a surface of said in-feed mechanism, said surface of said in-feed mechanism being in contacting engagement with said convolutely wound roll of web substrate.

14. The apparatus according to claim 13, wherein said source of negative pressure applies a negative pressure to an end of said convolutely wound roll of web substrate, thereby providing said end of said convolutely wound roll of web substrate in contacting engagement with said in-feed mechanism.

15. The apparatus according to claim 11, wherein said adhesive applicator has a longitudinal axis, said longitudinal axis of said adhesive applicator being generally parallel to a longitudinal axis of said convolutely wound roll of web substrate and wherein said manifold is provided with compartments therein.

16. The apparatus according to claim 15, wherein said compartments extend in a direction generally perpendicular to said longitudinal axis of said adhesive applicator.

17. The apparatus according to claim 15, wherein said compartments extend in a direction generally parallel to said longitudinal axis of said adhesive applicator.

18. The apparatus according to claim 11, wherein said at least one opening disposed within said first surface forms a pattern upon said convolutely wound roll of web substrate.

19. The apparatus according to claim 18, wherein said pattern is an indicia.

* * * * *